US005297705A

United States Patent [19]

Schmidt

[11] Patent Number: 5,297,705

[45] Date of Patent: Mar. 29, 1994

[54] BOW FORMING APPARATUS

[76] Inventor: Erich A. Schmidt, 2415 Liberty Rd., Lexington, Ky. 40509

[21] Appl. No.: 811,993

[22] Filed: Dec. 23, 1991

[51] Int. Cl.[5] ..... A41H 43/00; B21J 15/28

[52] U.S. Cl. ..... 223/46; 223/44; 83/DIG. 1; 227/1

[58] Field of Search ..... 223/46, 44; 30/140; 112/272; 83/58, DIG. 1; 227/1

[56] References Cited

U.S. PATENT DOCUMENTS

| | | | |
|---|---|---|---|
| 1,209,525 | 12/1916 | Webb | 223/46 |
| 2,528,820 | 11/1950 | Cook | 224/46 |
| 3,415,429 | 12/1968 | Lopata | 223/46 |
| 3,554,413 | 1/1971 | Thayer | 223/46 |
| 3,661,307 | 5/1972 | Jacobson | 223/46 |
| 4,000,395 | 12/1976 | Fisher | 30/140 X |
| 4,798,934 | 1/1989 | Boyer | 30/140 X |
| 4,848,256 | 7/1989 | Ohchi | 112/272 X |
| 5,072,865 | 12/1991 | Lyons | 223/46 |

FOREIGN PATENT DOCUMENTS

| | | | |
|---|---|---|---|
| 1523596 | 9/1978 | United Kingdom | 227/8 |

*Primary Examiner*—Clifford D. Crowder
*Assistant Examiner*—Bibhu Mohanty
*Attorney, Agent, or Firm*—Frank C. Leach, Jr.

[57] ABSTRACT

A strip of acetate of a selected length is cut from a ribbon of acetate by a heated cutting wire after the strip has a middle portion clamped between two pairs of fingers. A first outer portion of the strip is then folded beneath the middle portion of the strip at an angle thereto and adjacent thereto after which a second outer portion of the strip is folded at an angle to both the first outer portion and the middle portion and adjacent the first outer portion. The folded portions of the strip are held in the folded relationship as the fingers are advanced to an attaching apparatus at which the portions of the strip are attached to each other to form a bow and to a garment. Activation of the attaching apparatus is prevented if the operator has an extremity disposed in an area where the extremity will be struck by a portion of the attaching apparatus during activation of the attaching apparatus.

19 Claims, 13 Drawing Sheets

14

116
125
125C
127
128
126
126'

157
155
195
195'
137
199
198
20
197
135
154
203
115N
115G
115F
115H
115I
115A
115J
115K
115C
115B
115D
115L

BOW FORMING APPARATUS

This invention relates to an apparatus for forming a bow from a strip of material.

In the manufacture of garments of clothing, particularly children's garments, it is desired to have bows attached at various locations. The bow forming apparatus of the present invention enables automatic formation of a bow and its attachment to a garment at a specific location.

The bow forming apparatus of the present invention advances a ribbon of material a selected distance past cutting means during each cycle of operation so that the ribbon is cut to form a strip equal to the selected distance. Each strip, which is cut from the ribbon by the cutting means, has the same length and is used to form the bow. Holding means holds the portion of the ribbon of material to be cut to form a strip prior to cutting so that the strip is held after cutting by the holding means.

With the strip having its middle portion held by the holding means, the bow is formed by moving one of two outer portions of the cut strip at an angle to its middle portion and adjacent thereto. Then, the other of the two outer portions of the strip is folded at an angle to both the folded first outer portion and the middle portion and adjacent the first outer portion with all three portions being substantially the same length.

After folding of the two outer portions of the strip is completed, the folded strip is advanced to an attaching apparatus where the three portions are fastened to each other and to a garment to form a bow attached to the garment at a specific location. A single fastener holds the three portions of the strip to each other in the bow configuration and to the garment.

The present invention also includes a safety device for preventing activation of the attaching means if an operator's extremity such as a finger or hand, for example, is disposed where it will be struck by a portion of the attaching means when the attaching means is activated. This safety device prevents activation of the attaching means until the operator's extremity is removed from the area where it will be struck.

An object of this invention is to automatically form a bow from a strip of material.

Another object of this invention is to provide an apparatus for forming a bow.

A further object of this invention is to provide an arrangement for preventing activation of an attaching apparatus when an operator has an extremity in an area in which it will be struck by a portion of the attaching apparatus when the attaching apparatus is activated.

Other objects of this invention will be readily perceived from the following description, claims, and drawings.

The attached drawings illustrated a preferred embodiment of the invention, in which.

Figure 1:
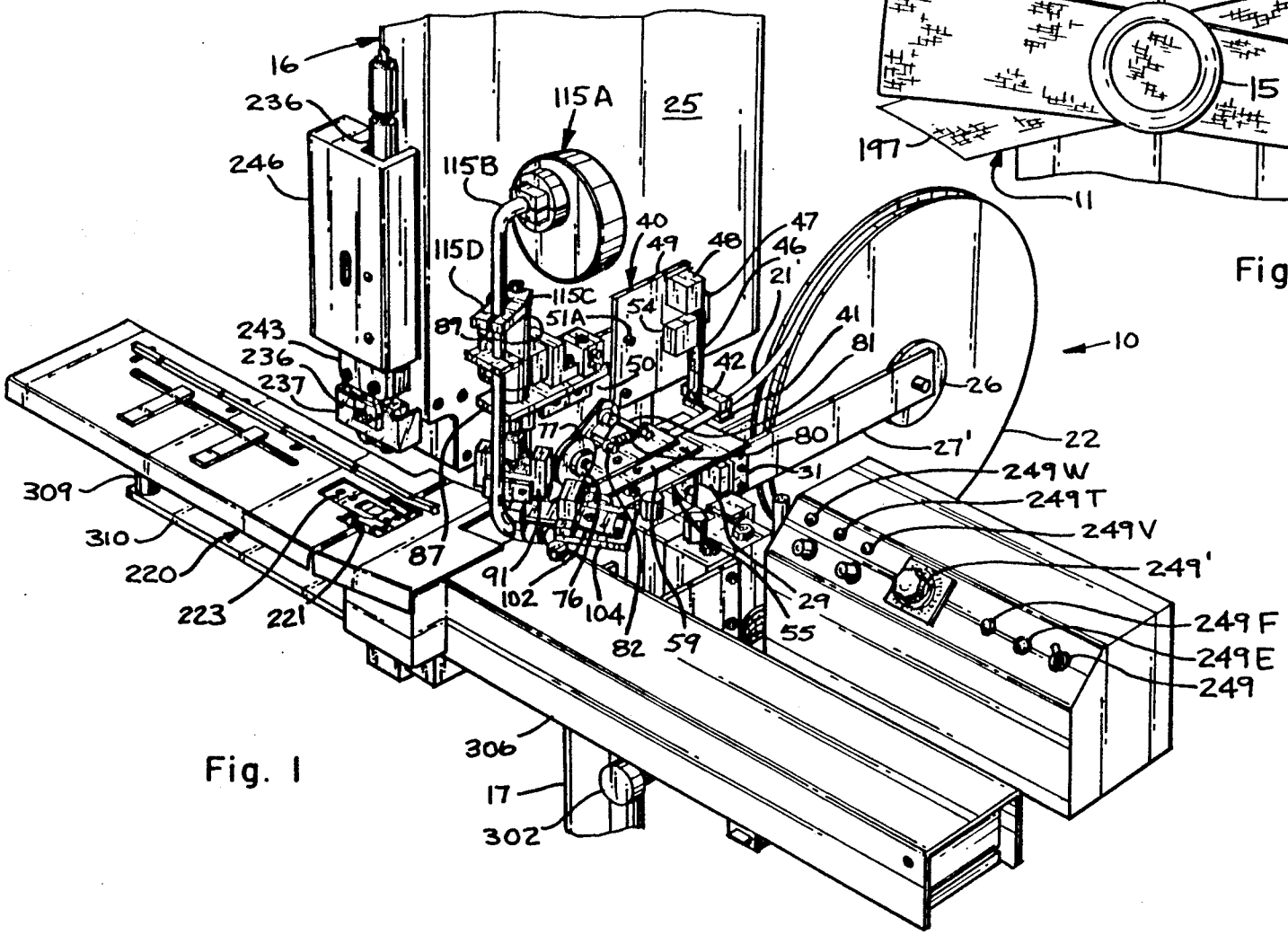
FIG. 1 is a perspective view of a bow forming apparatus of the present invention and an attaching apparatus utilized therewith.

Referring to the drawings and particularly FIG. 1, there is shown a bow forming apparatus 10 for forming a bow 11 (see FIG. 2) for attachment to a garment 12. The formed bow 11 is attached to the garment 12 by suitable attaching fasteners such as a socket 14 (see FIG. 17) and an open ring 15 (see FIG. 2).

The socket 14 (see FIG. 17) and the open ring 15 (see FIG. 2) attach the bow 11 (see FIG. 2) and the garment 12 to each other through an attaching apparatus 16 (see FIG. 1). Suitable examples of the attaching apparatus 16 are an attaching apparatus available from Universal Fastener, Inc., Lawrenceburg, Ky. as Model 0-2 and an attaching apparatus of U.S. Pat. No. 3,750,925 to Schmidt et al, which is incorporated by reference herein.

The attaching apparatus 16 loads the socket 14 (see FIG. 17) from the top and the open ring 15 (see FIG. 2) from the bottom in a manner similar to that shown and described in a aforesaid Schmidt et al patent. The attaching apparatus 16 (see FIG. 1) is supported in spaced relation to the floor by a base 17.

The bow 11 (see FIG. 2) is preferably formed of a material which can be cut by meat. One suitable example of the material of the bow 11 is an acetate.

Figure 3:
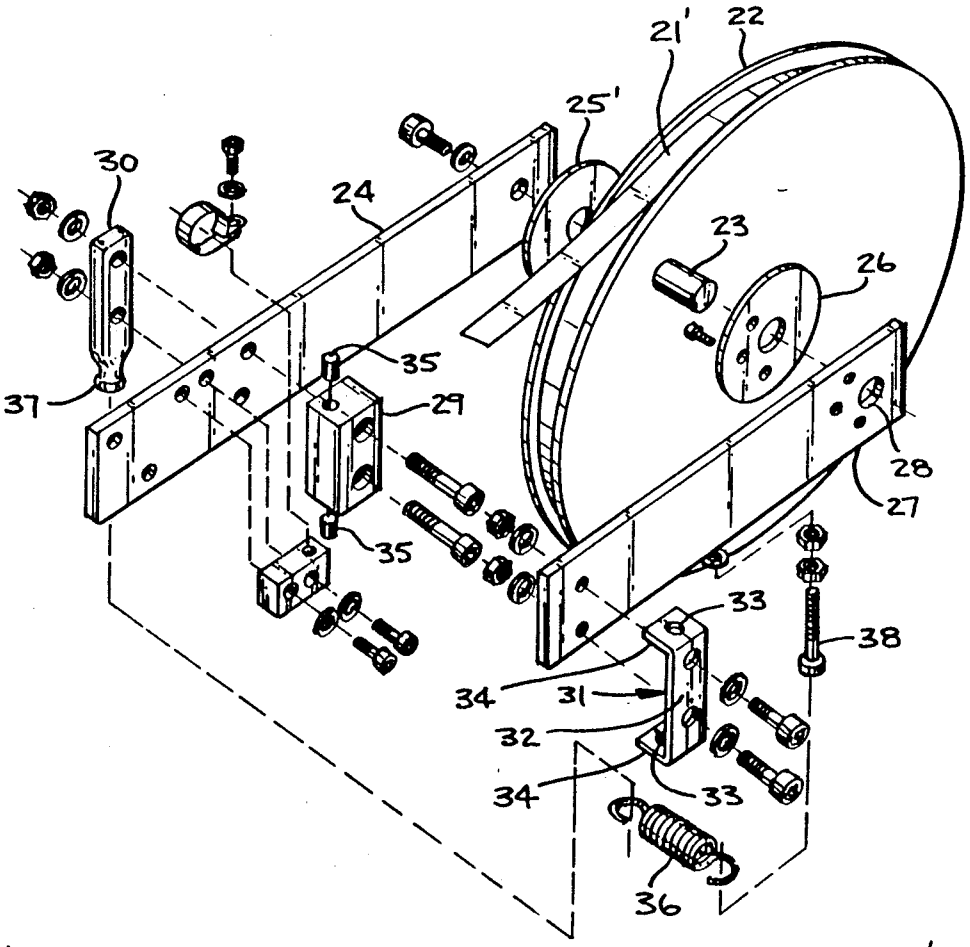
FIG. 3 is an exploded perspective view of a spool holder aeemmbly of the bow forming apparatus of FIG. 1.

The bow 11 is formed from a strip 20 (see FIG. 16) of material of a selected length cut by a heated cutting wire 21 (see FIG. 8) from a ribbon 21' (see FIG. 3) of material supplied from a rotatably mounted spool 22. The spool 22 is rotatably mounted on an axle 23, which is supported on a bar 24 fixed to a side plate 25 (see FIG. 6) of the attaching apparatus 16.

The axle 23 (see FIG. 3) extends from the bar 24 through a back up plate 25', the spool 22, a tension plate 26 attached to a pivotally mounted clamping bar 27, and an opening 28 in the clamping bar 27. The clamping bar 27 is pivotally mounted on a block 29, which is attached to the bar 24 and to a spring holder 30 on the opposite side of the bar 24 from the block 29.

The clamping bar 27 is pivotally mounted on the block 29 by a U-shaped bracket 31, which has its base 32 fixed to the clamping bar 27, having an opening 33 in each of its legs 34 to receive a pin 35. The pins 35 extend from opposite ends of the block 29 to pivotally support the clamping bar 27 for pivoting about the axis of the pins 35.

A spring 36 extends between a spring retainer portion 37 on the bottom of the spring holder 30 and a head of a bolt 38 extending from the bottom of the clamping bar 27. The spring 36 continuously urges the clamping bar 27 to its retaining position in which the axle 23 is received in the opening 28.

Figure 4:
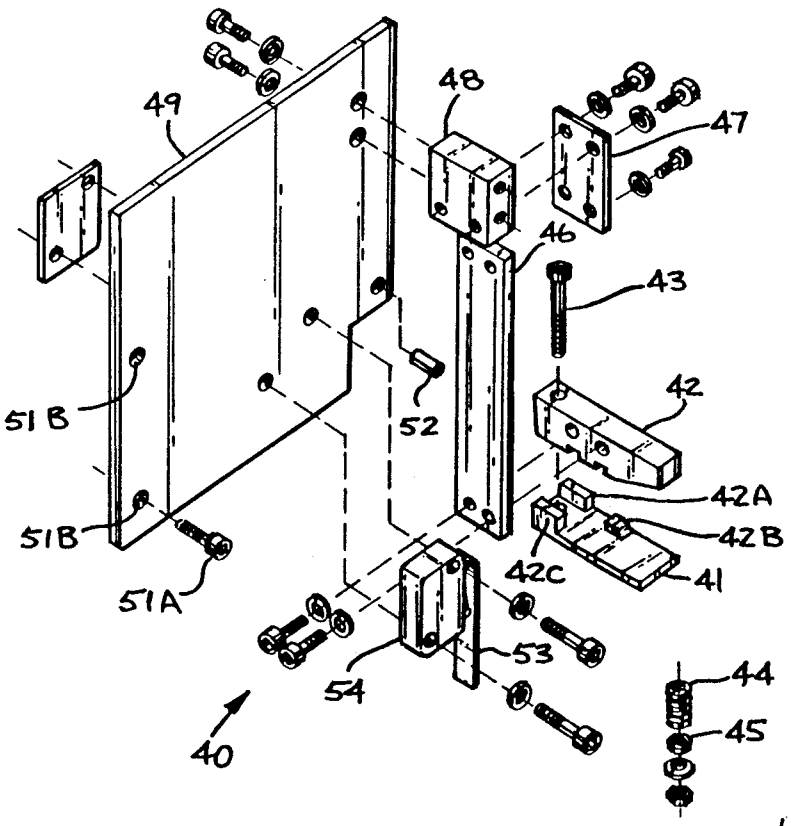
FIG. 4 is an exploded perspective view of a sensor of the bow forming apparatus of FIG. 1 for sensing when the thickness of a ribbon of material for use in forming the bow exceeds a predetermined thickness.

The ribbon 21' of material is fed from the spool 22 past a thickness sensor 40 (see FIG. 4). The thickness sensor 40 includes a bottom clamp 41 and an upper block 42 between which the ribbon 21' (see FIG. 3) of material passes. The bottom clamp 41 (see FIG. 4) has a pair of guide lugs 42A and 42B between which the ribbon 21' (see FIG. 3) of material initially passes and a guide lug 42C engaging an edge of the ribbon 21' (see FIG. 3) of material as it exits. The bottom clamp 41 (see FIG. 4) is resiliently connected to the upper block 42 through a bolt 43, which passes through the upper block 42 and the bottom clamp 41, having a spring 44 retained thereon by a nut 45.

The upper block 42 is mounted on the bottom end of a bar 46, which is pivotally connected by a flat spring 47 to a block 48. The block 48 is fixed to a mounting plate 49. The mounting plate 49 is supported on a mounting plate 50 (see FIG. 7) of a guide assembly 51 through two bolts 51A (see FIG. 4) extending through two holes 51B in the mounting plate 49 into two threaded holes 51C (see FIG. 7) in the mounting plate 50.

Whenever the thickness of the ribbon 21' (see FIG. 3) of material passing between the bottom clamp 41 (see FIG. 4) and the upper block 42 from the spool 22 (see FIG. 3) exceeds a predetermined thickness, the ribbon 21' cannot pass between the bottom clamp 41 (see FIG. 4) and the upper block 42 so that the bar 46 is caused to pivot about the spring 47, which is continuously urging the bar 46 against a stop pin 52 on the mounting plate 49, through the force of the spring 47 being overcome. The pivoting of the bar 46 moves it into engagement with a finger 53 on a limit microswitch 54, which is supported by the mounting plate 49. Opening of the normally closed contacts of the limit microswitch 54 stops further operation of the bow forming apparatus 10 (see FIG. 1) until the portion of the ribbon 21' (see FIG. 3) of material exceeding the predetermined thickness is manually cut from the remainder of the ribbon 21' of material.

Figure 5:
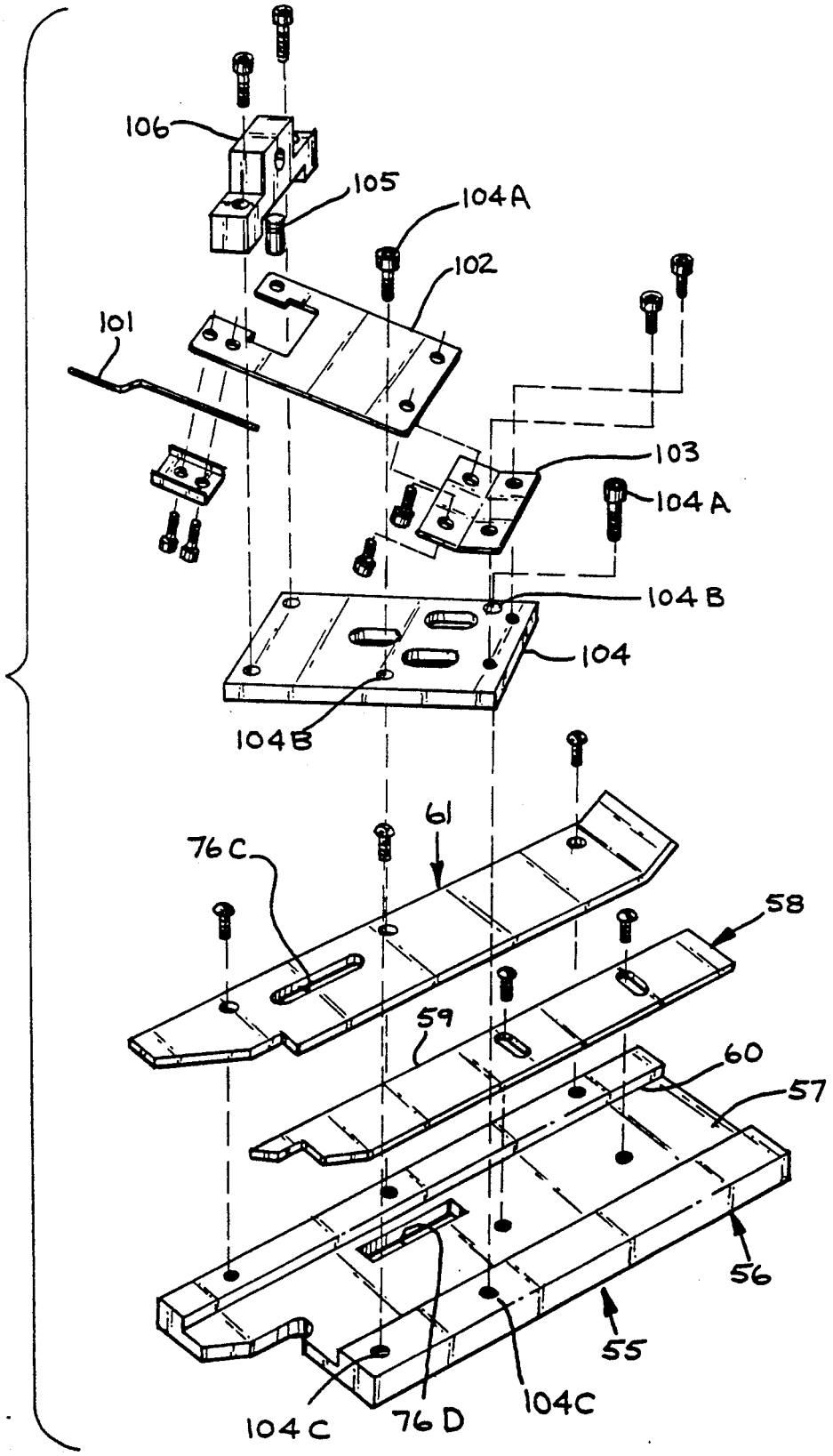
FIG. 5 is an exploded perspective view of a ribbon guide assembly of the bow forming apparatus of FIG. 1 for guiding the ribbon after the ribbon of material has passed the sensor of FIG. 4.

After the ribbon 21' of material passes the sensor 40 (see FIG. 4), the ribbon 21' (see FIG. 3) of material enters a ribbon guide assembly 55 (see FIG. 5). The ribbon guide assembly 55 includes a plate 56 having a groove 57 within which is disposed a guide 58 having its side surface 59 serve as a guide for one of two edges of the ribbon 21' (see FIG. 3) of material as it passes therethrough. The other edge of the ribbon 21' of material is guided by a side surface 60 (see FIG. 5) of the groove 57 in the plate 56. A cover 61 overlies the surface 59 of the guide 48 and the surface 60 of the groove 57 to retain the ribbon 21' (see FIG. 3) of material in the groove 57 (see FIG. 5) between the surfaces 59 and 60.

The ribbon 21' (see FIG. 3) of material is advanced through the ribbon guide assembly 55 (see FIG. 5) by rotation of a drive wheel 62 (see FIG. 6) of a ribbon feed or advancing assembly 62'. The drive wheel 62 is driven through a gear 63 on a shaft 64 of an air driven rotary actuator 65 meshing with a gear 66 on an axle 67 of the drive wheel 62. One suitable example of the rotary actuator 65 is sold by Turn-Act of Louisville, Ky. as Model S-16.

Figure 6:
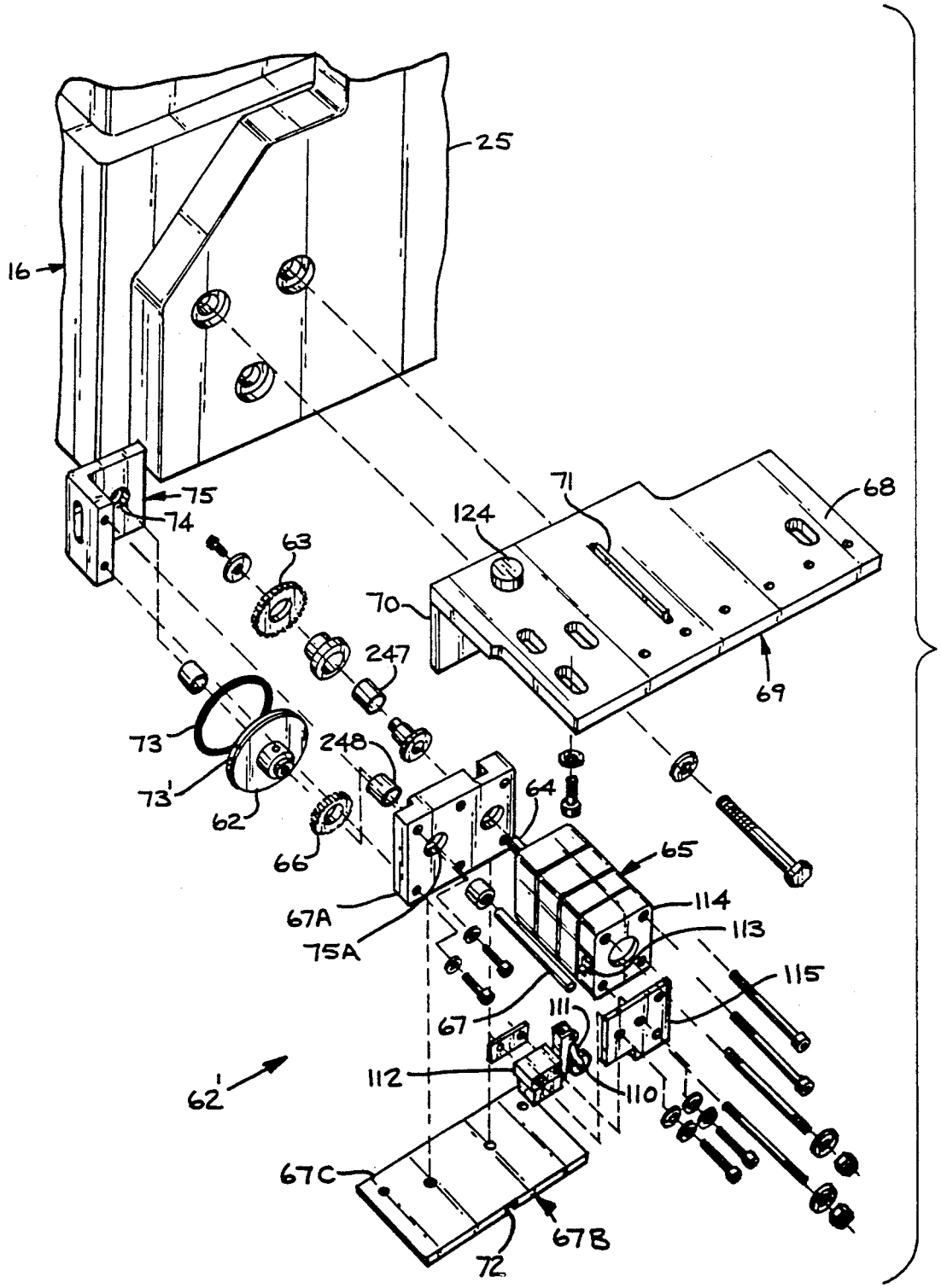
FIG. 6 is an exploded perspective view of a ribbon advancing assembly of the bow forming apparatus of FIG. 1.

The rotary actuator 65 is supported by a block 67A, which is mounted on a base 67B having three threaded holes (not shown) in its edge 67C to receive three bolts (not shown) passing through three holes 67D (see FIG. 7) in the mounting plate 50 to attach the mounting plate 50 to the base 67B (see FIG. 6). The base 67B is adjustably mounted for sliding movement on a horizontal portion 68 of an L-shaped bracket 69 having its vertical portion 70 fixed to the side plate 25 of the attaching apparatus 16. The horizontal portion 68 of the L-shaped bracket 69 has a key 71 extending upwardly therefrom for cooperation with a keyway 72 in the bottom surface of the base 67B to enable adjustment of the drive wheel 62 relative to the path of the ribbon 21' (see FIG. 3) of the material. The drive wheel 62 (see FIG. 6), which has an O-ring 73 in a groove 73' on its outer surface, has the axle 67 supported in an opening 74 in an L-shaped bearing mount 75, which is connected to the block 67A, and in an opening 75A in the block 67A.

A resiliently biased pressure wheel 76 (see FIG. 7), which has an O-ring 76A in a groove 76B on its outer surface, extends through a slot 76C (see FIG. 5) in the cover 61 of the ribbon guide assembly 55, to hold the ribbon 21' (see FIG. 3) of material against the drive wheel 62 (see FIG. 6), which extends through an elongated slot 76D (see FIG. 5) in the groove 57 of the plate 56. The pressure wheel 76 (see FIG. 7) is rotatably supported on a lever 77, which is pivotally mounted on a bushing 79 secured to the mounting plate 50 by a screw 79'. A spring 80 extends between a stud 81, which extends from the mounting plate 50, and a stud 82, which extends from the lever 77. The spring 80 resiliently biases the O-ring 76A on the pressure wheel 76 continuously against the ribbon 21' (see FIG. 3) of material to hold it against the O-ring 73 (see FIG. 6) on the drive wheel 62 so that rotation of the drive wheel 62 advances the ribbon 21' (see FIG. 3) of material.

The mounting plate 50 (see FIG. 7) also supports a cutter assembly 85 (see FIG. 8) through having a vertical portion 86 of an L-shaped bracket 87 of the cutter assembly 85 attached to its upper end by two enlarged slots 87A in the vertical portion 86 receiving two bolts (not shown) for disposition in two threaded holes 87B (see FIG. 7) in the mounting plate 50. The L-shaped bracket 87 (see FIG. 8) has its horizontal portion 88 supporting an air cylinder 89 having its piston rod 90 connected to an electrically insulated support block 91, which supports an electrode 92 on one side and two electrodes 93 and 93' on its other side.

The cutting wire 21 is connected to the electrodes 92 and 93, which is connected to the electrode 93'. The electrode 93' is a spring material to maintain the electrode 93 under tension so that the cutting wire 21 remains straight and under tension.

Figure 12:
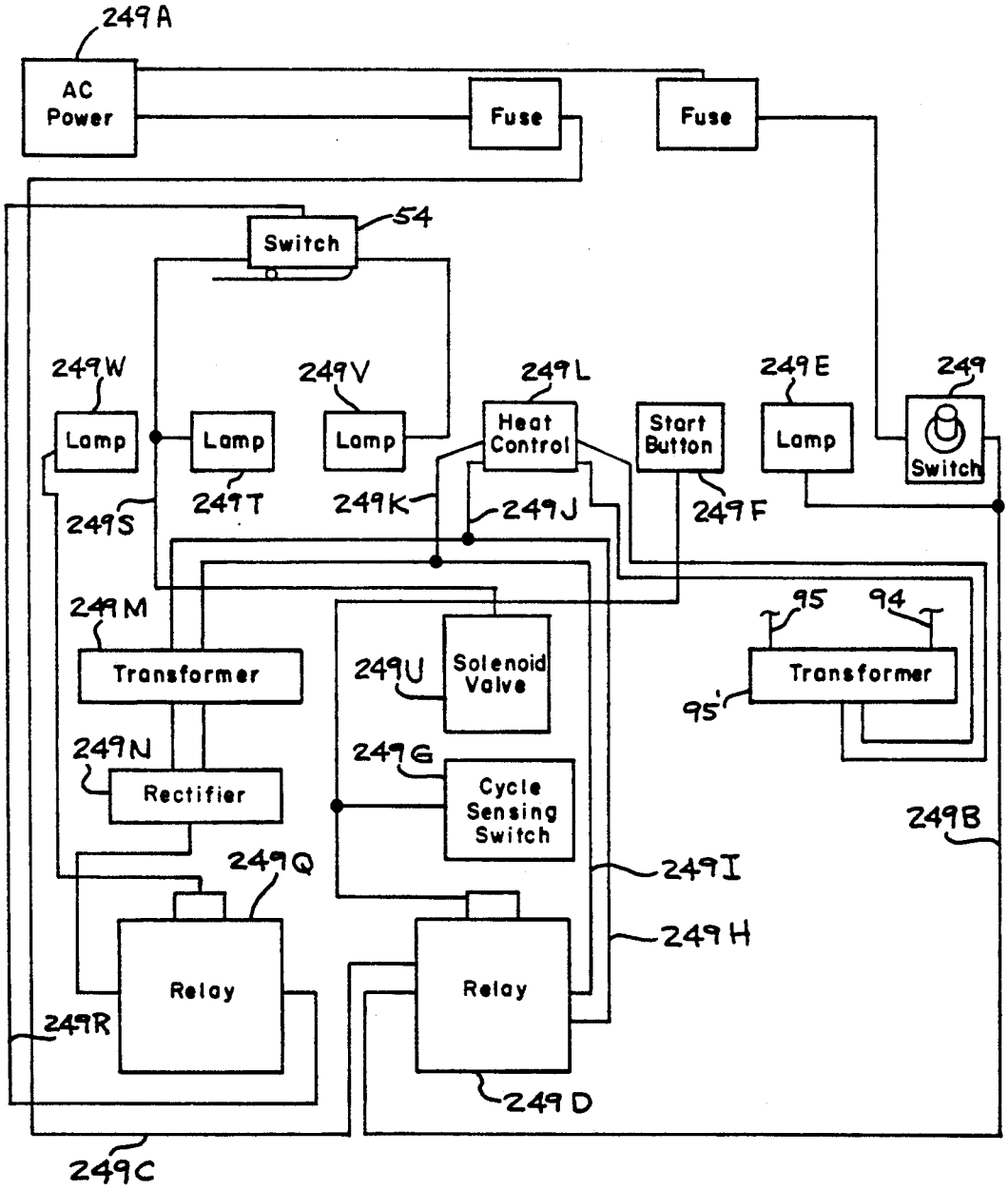
FIG. 12 is a schematic diagram of an electric circuit for the bow forming apparatus of FIG. 1.

When the electrodes 92, 93, and 93' are energized through wires 94 and 95 from a low voltage transformer 95' (see FIG. 12), the cutting wire 21 (see FIG. 8) is heated. Because the insulated support block 91 is disposed at an angle of 45° to the path of the ribbon 21' (see FIG. 3) of material, the ribbon 21' of material is cut at an angle of 45° by the heated cutting wire 21 (see FIG. 8).

When pressurized air is supplied to the air cylinder 89 to retract the piston rod 90 to lift the insulated support block 91, the electrodes 93, 93, and 93' are energized, if they are not already energized, to heat the cutting wire 21. The heating of the cutting wire 21 must occur for a sufficient period of time (ten seconds, for example) prior to the pressurized air being supplied to the air cylinder 89 so that the cutting wire 21 is at the desired cutting temperature when its upward movement begins. The cutting wire 21 may already have been heated for the predetermined period of time depending on when the last cycle of operation occurred.

Upward movement of the cutting wire 21 by the piston rod 90 being lifted through pressurized air supplied to the air cylinder 89 is stopped when the position of a limit valve 96, which is supported on the horizontal portion 88 of the L-shaped bracket 87 by a mounting block 97, is shifted. The shifting of the position of the limit valve 96 occurs when a trip rod 98, which is carried by a block 99 attached to the insulated support block 91, engages a plunger 100 of the limit valve 96.

The shifting of the position of the limit switch 96 not only stops the pressurized air supply to the air cylinder 89 but also vents it therefrom. The venting of the pressurized air from the air cylinder 89 enables a spring 100' (see FIG. 11) within the air cylinder 89 to return the piston rod 90 and the insulated support block 91 (see FIG. 8) to their lowermost positions whereby the cutting wire 21 returns to its lowermost position.

Figure 8:
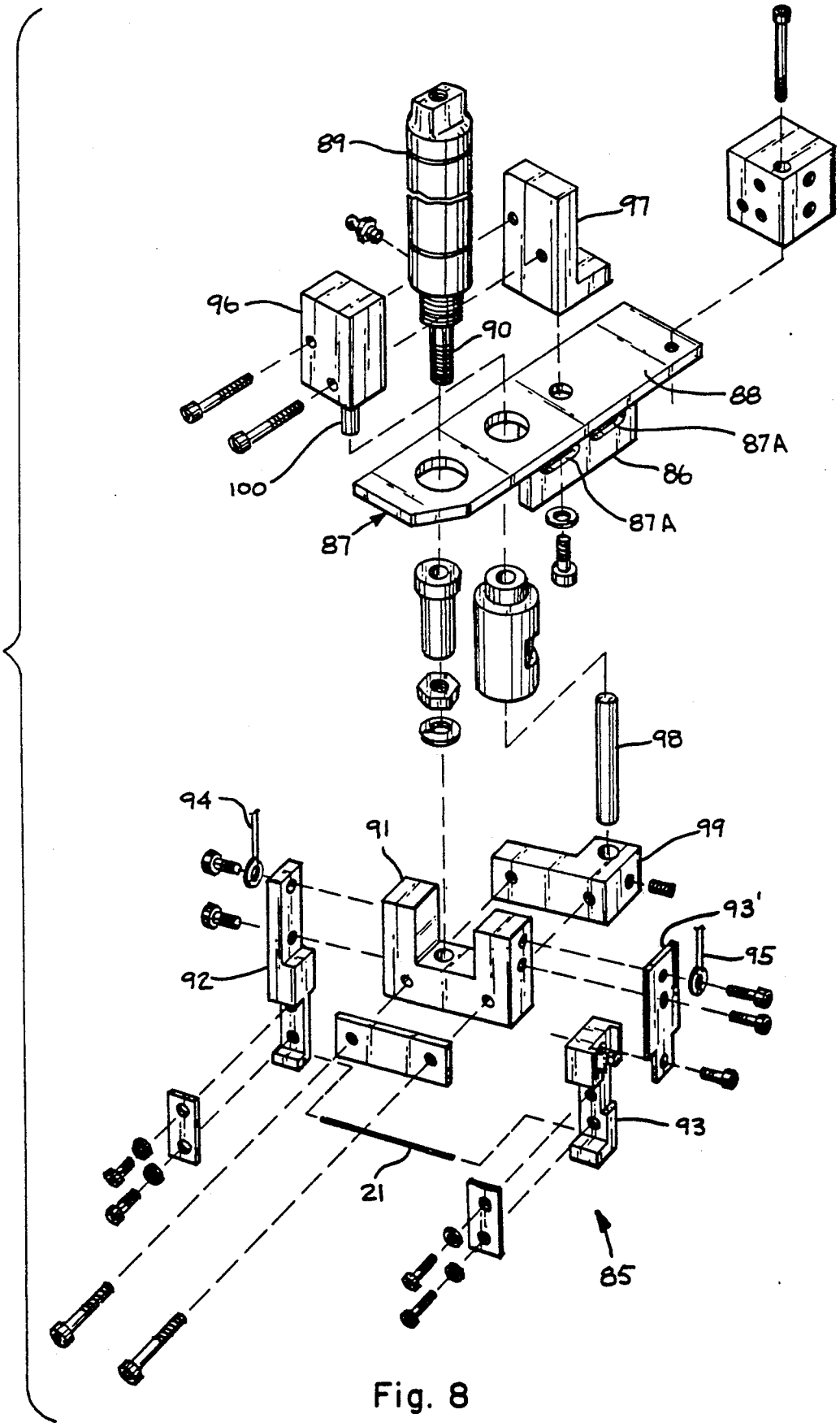
FIG. 8 is an exploded perspective view of a cutter assembly of the bow forming apparatus of FIG. 1.

During cutting of the ribbon 21' (see FIG. 3) of material by the heated cutting wire 21 (see FIG. 8), a hold-down wire 101 (see FIG. 5) of the ribbon guide assembly 55 holds the ribbon 21' (see FIG. 3) of material against the cutting wire 21 (see FIG. 8) by engaging the ribbon 21' (see FIG. 3) of material on the opposite side from the cutting wire 21 (see FIG. 8). The hold-down wire 101 (see FIG. 5) is attached to a clamp plate 102, which is connected by an angled flat spring 103 to a mounting plate 104.

The mounting plate 104 is supported by the plate 56 and is disposed at an angle 45° to the path of the ribbon 21' (see FIG. 3) of material through having two screws 104A (see FIG. 5) extend through two holes 104B in the mounting plate 104 into two threaded holes 104C in the plate 56. Extension of a piston 105 of an air cylinder 106, which is supported on the mounting plate 104, moves the clamp plate 102 and the hold-down wire 101 downward to the position in which the hold-down wire 101 holds the ribbon 21' (see FIG. 3) of material against the cutting wire 21 (see FIG. 8).

A spring 107 (see FIG. 11) within the air cylinder 106 returns the hold-down wire 101 (see FIG. 5) to its initial, raised position when pressurized air is vented from the air cylinder 106. This occurs by shifting of the position of the limit valve 96 (see FIG. 8).

Prior to cutting the ribbon 21' (see FIG. 3) of material, the ribbon 21' of material is advanced by the drive wheel 62 (see FIG. 6) for a predetermined distance past the cutting wire 21 (see FIG. 8) by the rotary actuator 65 (see FIG. 6). The shaft 64 of the rotary actuator 65 has a cam (not shown) thereon to engage a roller 110 on the end of a pivotally mounted finger 111 on a limit valve 112 to shift the position of the limit valve 112 when the ribbon 21' (see FIG. 3) of material has been advanced the predetermined distance, which is equal to the length of the strip 20 (see FIG. 16), past the cutting wire 21 (see FIG. 8).

The roller 110 (see FIG. 6) on the finger 111 extends into an opening 113 in an end cap 114 on the rotary actuator 65. The limit valve 112 is supported on a mounting plate 115, which is attached to the end cap 114 on the rotary actuator 65.

Accordingly, the strip 20 (see FIG. 16) of material cut from the ribbon 21' (see FIG. 3) of material is always the same length. Furthermore, by having the cutting wire 21 (see FIG. 8) at an angle of 45° to the path of advancement of the ribbon 21' (see FIG. 3) of material by the drive wheel 62 (see FIG. 6), each end of the strip 20 (see FIG. 16) of material is formed at an angle of 45°.

Figures 15, 16, 17, 18:
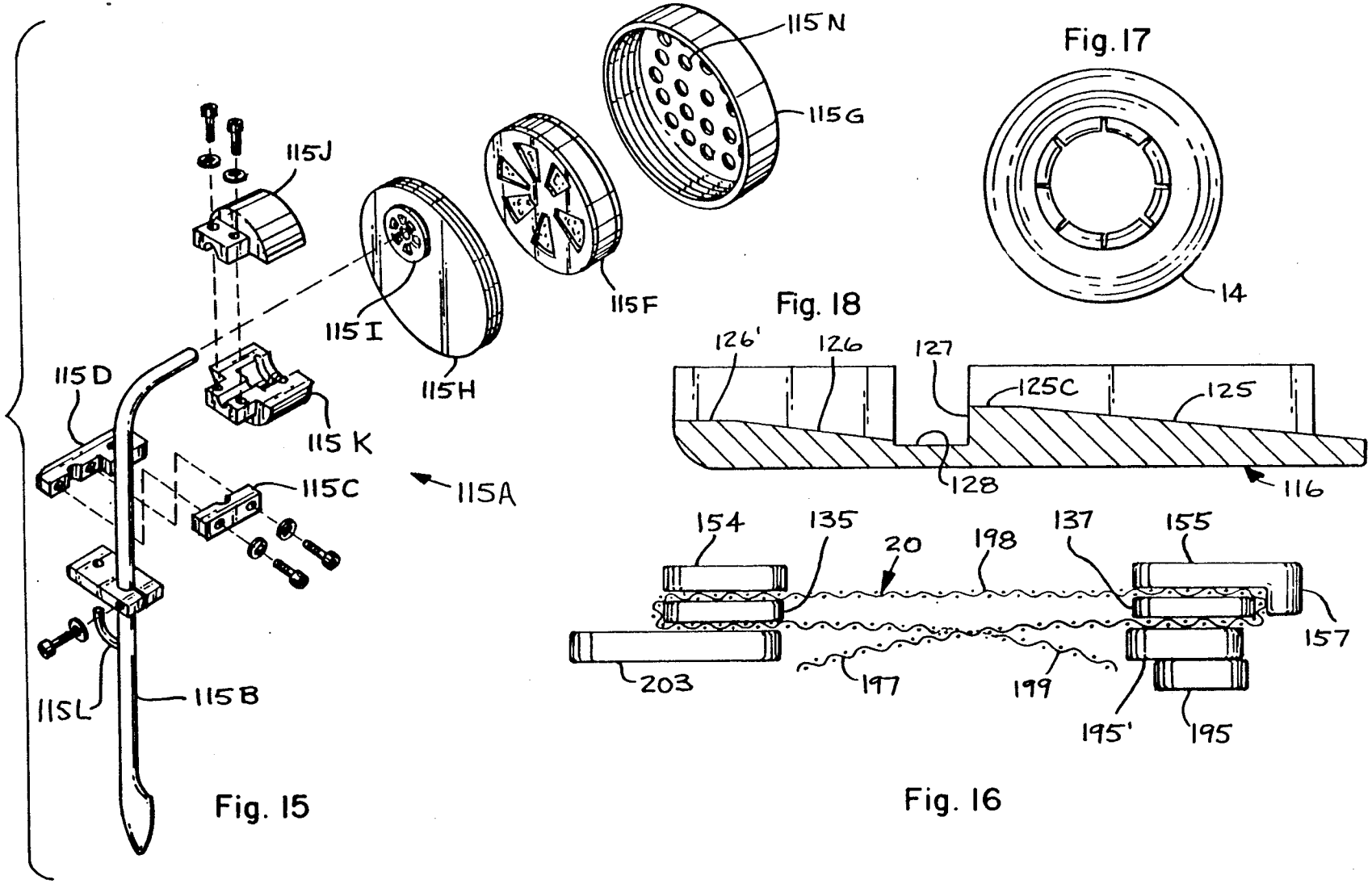
FIG. 15 is an exploded perspective view of a filter assembly of the bow forming apparatus of FIG. 1.
FIG. 16 is a schematic end view showing a strip of material clamped in its bow configuration prior to attachment to a garment.
FIG. 17 is a top plan view of a socket used to attach a formed bow to a garment.
FIG. 18 is a sectional view, partly in elevation, of a guide of the guide assembly of FIG. 7 and taken along line 18—18 of FIG. 7.

During cutting of the ribbon 21' (see FIG. 3) of material by the heated cutting wire 21 (see FIG. 8), the gases produced by cutting are removed by a filter assembly 115A (see FIG. 15). The filter assembly 115A includes a tube 115B having its lower end disposed adjacent the area where the heated cutting wire 21 (see FIG. 8) cuts the ribbon 21' (see FIG. 3) of material. The tube 115B (see FIG. 15) is supported on the air cylinder 89 (see FIG. 8) of the cutter assembly 85 by a clamp 115C and a mount 115D retaining the tube 115B therebetween and secured by the mount 115D to the top of the air cylinder 89 (see FIG. 8).

The upper end of the tube 115B (see FIG. 15) has a charcoal filter 115F, which is retained between two rings 115G and 115H, to absorb the gases from the cutting operation. The ring 115H has an eccentrically disposed projecting portion 115I to receive the upper end of the tube 115B and be clamped thereto by clamps 115J and 115K.

Pressurized air is supplied through an air tube 115L to the tube 115B to remove the gases produced by cutting. This pressurized air creates a vacuum at the entrance to the bottom of the tube 115B to induce the gases into the tube 115B for flow through the filter 115F after which the filtered air passes through openings 115N in the end of the ring 115G.

The ribbon 21' (see FIG. 3) of material is advanced past the cutting wire 21 (see FIG. 8) by the drive wheel 62 (see FIG. 6) into a U-shaped guide 116 (see FIG. 7), which is supported on a pivotally mounted lever 117. The lever 117 is pivotally mounted on a bushing 118 attached to the mounting plate 50 by a screw 118'.

The lever 117 is pivoted by extension and retraction of a piston rod 119 of an air cylinder 120 through the piston rod 119 being connected to the lever 117 intermediate its ends. The air cylinder 120 is supported at an angle on the mounting plate 50 through a U-shaped mount 121 having its two holes 121A receive two screws 121B for disposition in threaded holes 121C at slightly different elevations in the mounting plate 50.

A U-shaped or channel shaped guide bar 122 is attached to the mounting plate 50 and has the lever 117 passing between the guide bar 122 and the mounting plate 50. A bumper 123, which is mounted on the bottom of the air cylinder 120, limits upward movement of the portion of the lever 117 having the guide 116 by engaging the lever 117. A bumper 124 (see FIG. 6), which is mounted on the horizontal portion 68 of the L-shaped bracket 69, limits downward movement of the portion of the lever 117 (see FIG. 7) having the guide 116 by engaging the lever 117.

When the ribbon 21' (see FIG. 3) of material is advanced past the cutting wire 21 (see FIG. 8), the lever 117 (see FIG. 7) is engaging the bumper 123 (see FIG. 7) on the air cylinder 120. Thus, the guide 116 is in its uppermost position.

The guide 116 has a beveled entry surface 125 (see FIG. 18) between its slightly converging sides 125A (see FIG. 7) and 125B, which become substantially parallel at a flat surface 125C (see FIG. 18). The surface 125 is aligned with the surface of the groove 57 (see FIG. 5) in the plate 56 when the guide 116 (see FIG. 7) is in its uppermost position. The guide 116 has a beveled or angled surface 126 (see FIG. 18), which is lower than the flat surface 125C and separated therefrom by a slot 127 having a flat surface 128 lower than the angled surface 126. A flat exit surface 126' extends from the angled surface 126.

Two air jet tubes 129 (see FIG. 7) and 130 are supported on the opposite sides 125A and 125B, respectively, of the guide 116 to supply pressurized air to opposite sides of the ribbon 21' (see FIG. 3) of material during its advancement along the surfaces 125 (see FIG. 18) and 125C of the guide 116. This insures that the ribbon 21' (see FIG. 3) of material remains on its desired path.

Figure 9:
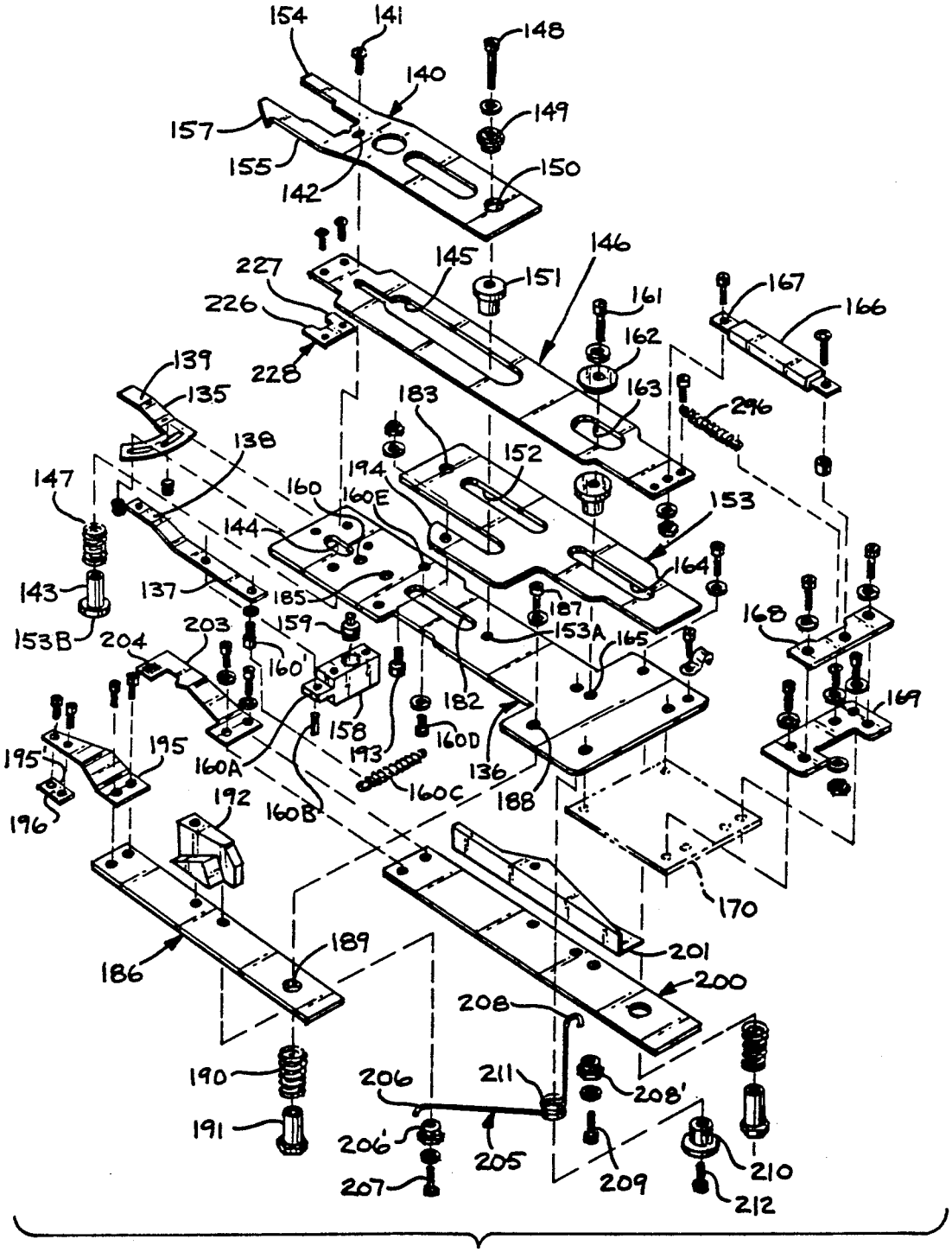
FIG. 9 is an exploded perspective view of a portion of a folding head slide of the bow forming apparatus of FIG. 1.

When the guide 116 (see FIG. 7) is raised to its uppermost position in which it can receive the ribbon 21' (see FIG. 3) of material by the air cylinder 120 (see FIG. 7) causing pivoting of the lever 117 prior to the ribbon 21' (see FIG. 3) of material being advanced from the spool 22 to the guide 116 (see FIG. 7), the slot 127 in the guide 116 receives a first finger 125 (see FIG. 9) on a base slide 136. A second finger 137 on the base slide 136 is positioned at the end of the guide 116 (see FIG. 7) so that the second finger 137 (see FIG. 9) has its upper surface 138 lower than the flat surface 126' (see FIG. 7) of the guide 116. The first finger 135 (see FIG. 9) has its upper surface 139 in the same plane as the flat surface 125C (see FIG. 18) of the guide 116. This arrangement insures that the ribbon 21' (see FIG. 3) of material does not hang up when it passes from the upper surface 139 (see FIG. 9) of the finger 135 in the slot 127 (see FIG. 7) as could occur if the angled surface 135 of the guide 116 were the same height as the upper surface 139 (see FIG. 9) of the finger 135.

Therefore, when the ribbon 21' (see FIG. 3) of material is advanced into the guide 116 (see FIG. 7), the ribbon 21' (see FIG. 3) of material rests on the upper surface 139 (see FIG. 9) of the first finger 135 and the upper surface 138 of the second finger 137.

A clamp 140 is resiliently connected to the base slide 136 and disposed thereabove. The clamp 140 is resiliently connected to the base slide 136 by a screw 141 extending through an opening 142 in the clamp 140 into a threaded opening in the upper end of a bushing 143, which extends through an enlarged opening 144 in the base slide 136 and an elongated slot 145 in a pusher 146 to enable sliding movement of the pusher 146 relative to the clamp 140. The bushing 143 supports a spring 147, which bears against the bottom of the base slide 136, that continuously urges the clamp 140 towards the base slide 136. The clamp 140 also is connected to the base slide 136 by a screw 148 extending through a bushing 149 in an opening 150 in the clamp 140, a bushing 151 in the elongated slot 145 in the pusher 146, and an elongated slot 152 in a slide-cam 153 into a threaded hole 153A in the base slide 136.

The spring 147 continuously urges the clamp 140 downwardly towards the base slide 136 through acting on a flange 153B on the bushing 143 so that a first finger 154 on the clamp 140 is disposed over the first finger 135 on the base slide 136 to hold or clamp the strip 20 (see FIG. 16) of material therebetween. The clamp 140 (see FIG. 9) has a second finger 155 disposed over the second finger 137 on the base slide 136 to clamp or hold the strip 20 (see FIG. 16) of material therebetween. The second finger 155 (see FIG. 9) of the clamp 140 has an angled edge 157, which extends downwardly and inwardly and towards the second finger 137 on the base slide 136.

When the ribbon 21' (see FIG. 3) of material is to be fed to the guide 116 (see FIG. 7), the fingers 154 (see FIG. 9) and 155 of the clamp 140 are spaced upwardly from the fingers 135 and 137 on the base slide 136 due to pressurized air being supplied to an air cylinder 158, which is mounted on the bottom of the base slide 136. The air cylinder 158 has a piston 159 extending through an opening 160 in the base slide 136 and the elongated slot 145 in the pusher 146 to exert an upward force against the bottom of the clamp 140.

The air cylinder 159 has a flange 160A on one end pivotally supporting the second finger 137 thereon by a pin 160B. A spring 160C extends between a bolt 160' on the second finger 137 and a bolt 160D threaded into a hole 160E in the base slide 136 to hold the second finger 137 in the desired position during formation of the bow 11 (see FIG. 2) while allowing movement of the second finger 137 (see FIG. 9) toward the first finger 135 when the fingers 135 and 137 are withdrawn from the formed bow 11 (see FIG. 2).

The pusher 146 (see FIG. 9) and the slide-cam 153 also are connected to the base slide 136 by a screw 161 extending through a flat washer 162 in an elongated slot 163 in the pusher 146 and an elongated slot 164, which is substantially longer than the elongated slot 163 in the slide-cam 153. The screw 161 extends into a threaded hole 165 in the base slide 136.

The length of the elongated slot 163 controls the amount of motion of the pusher 146 by a flat air cylinder 166 having its flat piston rod 167 connected to an end of the pusher 146. The air cylinder 166 is connected to an adjustment bar 168, which is mounted on a mounting plate 169 attached to the base slide 136 by a connecting plate 170.

After the ribbon 21' (see FIG. 3) of material has been advanced through the guide 116 (see FIG. 7) by the drive wheel 62 (see FIG. 6) being rotated by the rotary actuator 65 so that the ribbon 21' (see FIG. 3) of material is between the first finger 135 (see FIG. 9) on the base slide 136 and the first finger 154 of the clamp 140 and between the second finger 137 on the base slide 136 and the second finger 155 of the clamp 140, pressurized air is removed from the air cylinder 158. This results in the spring 147 urging the clamp 140 downwardly so that the first finger 154 of the clamp 140 clamps a portion of the ribbon 21' (see FIG. 3) of material against the first finger 135 (see FIG. 9) on the base slide 136 and the second finger 155 of the clamp 140 clamps another portion of the ribbon 21' (see FIG. 3) of material against the second finger 137 (see FIG. 9) on the base slide 136. Accordingly, the ribbon 21' (see FIG. 3) of material is clamped prior to cutting by the heated cutting wire 21 (see FIG. 8).

Figure 7:
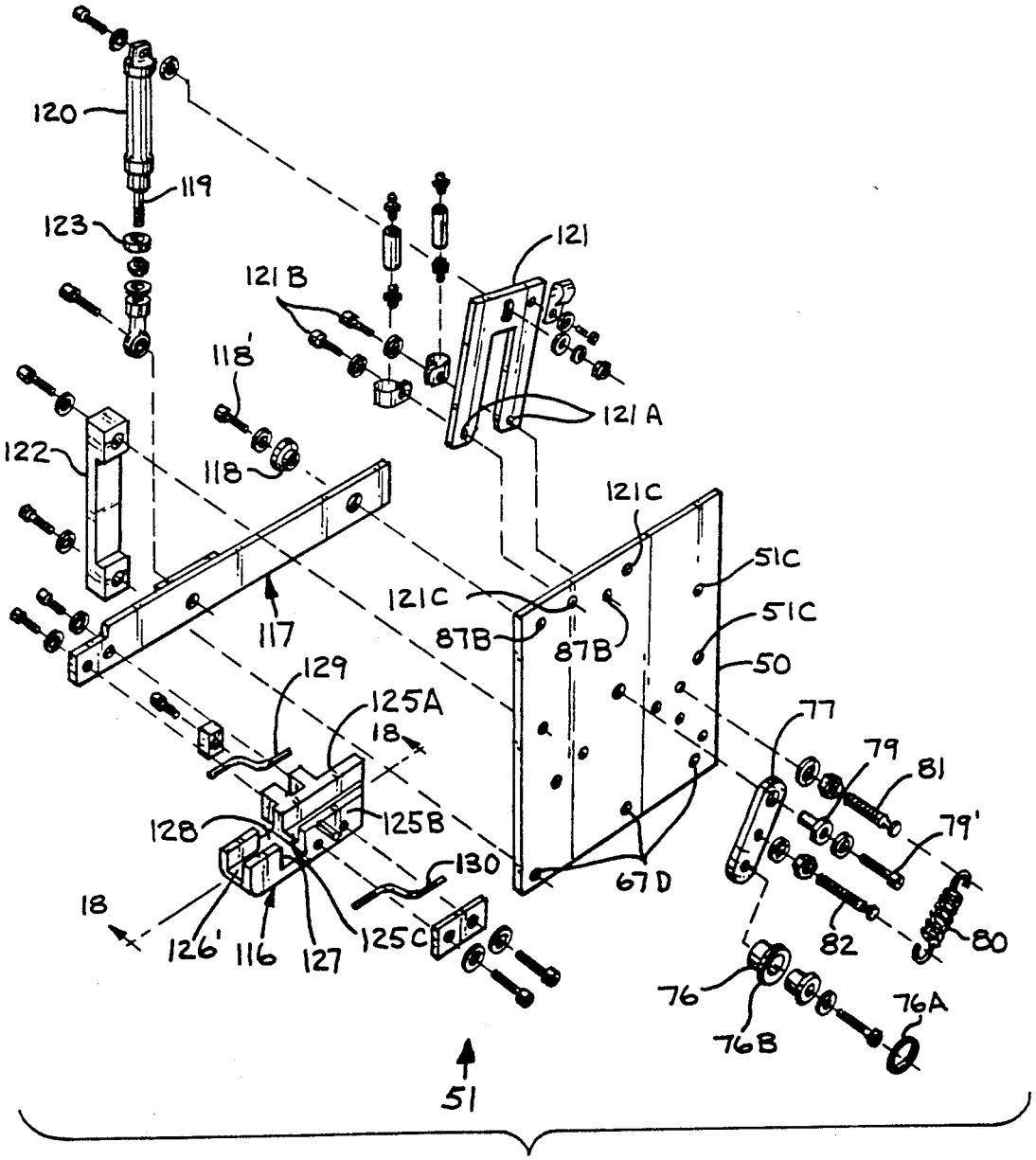
FIG. 7 is an exploded perspective view of a guide assembly of the bow forming apparatus of FIG. 1 for guiding the ribbon after the ribbon has passed the ribbon advancing assembly of FIG. 6.

At the time that the pressurized air is removed from the air cylinder 158 (see FIG. 9), the flow of pressurized air to the air cylinder 120 (see FIG. 7) is reversed to move the guide 116 downwardly until the portion of the lever 117 having the guide 116 engages the bumper 124 (see FIG. 6) on the bracket 69 to stop downward pivoting of the lever 117 (see FIG. 7). Thus, the guide 116 is moved away from the fingers 135 (see FIG. 9) and 137 before clamping of the ribbon 21' (see FIG. 3) of material.

Figure 11:
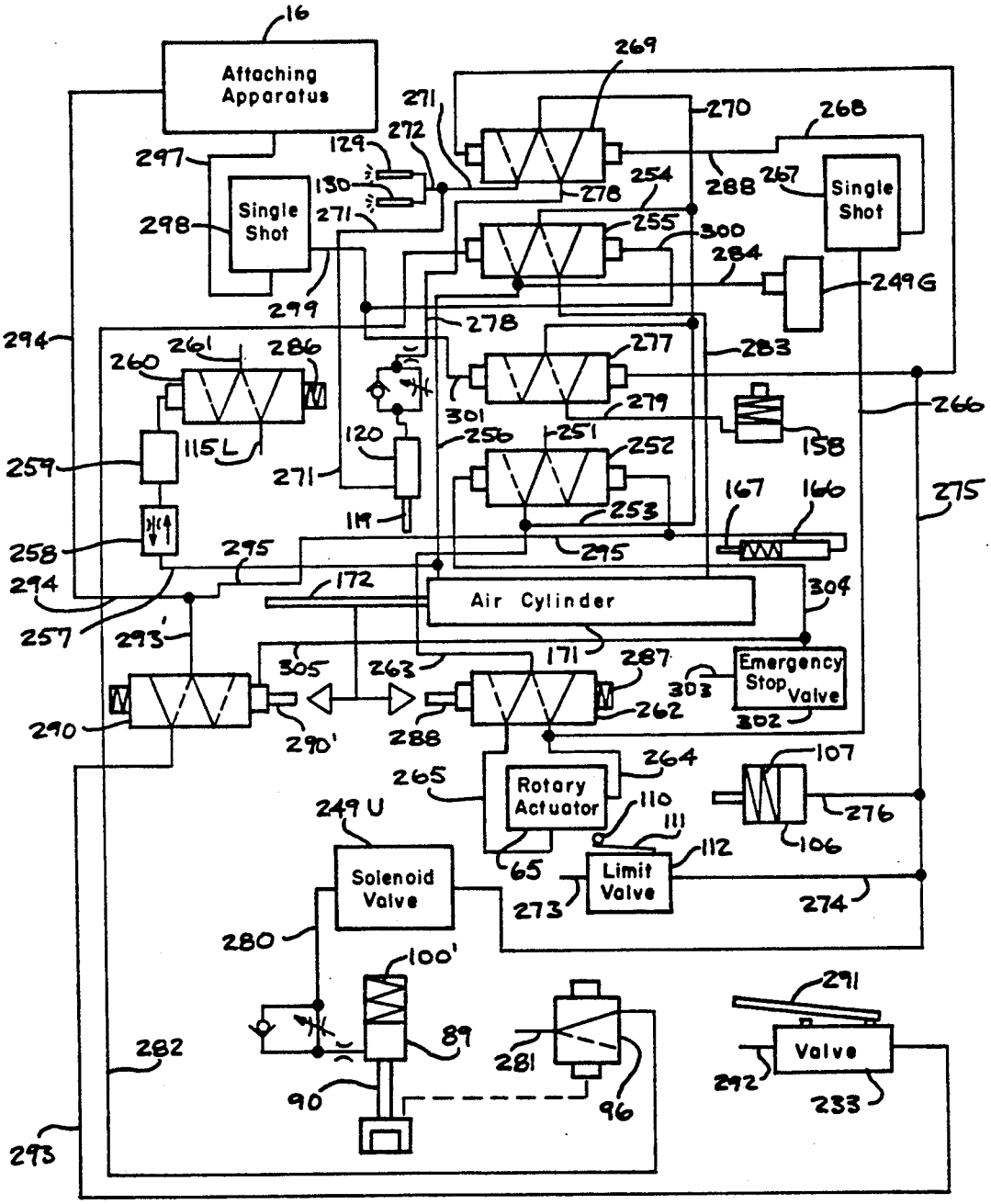
FIG. 11 is a schematic diagram of a pneumatic control system of the bow forming apparatus of FIG. 1.

After cutting by the heated cutting wire 21 in an upward direction is completed, pressurized air is removed from the air cylinder 89 (see FIG. 11). The spring 100' moves the insulated support block 91 (see FIG. 8) downwardly to return the heated cutting wire 21 to its non-cutting or start position.

When this occurs, pressurized air is supplied to an air cylinder 171 (see FIG. 10) to extend its piston rod 172 therefrom. The air cylinder 171 has its end opposite the piston rod 172 pivotally connected by a clevis pin 173 to an L-shaped mount 174, which is fixed to a base 175. The base 175 is fixed to the bracket 69 (see FIG. 6).

Intermediate its ends, the air cylinder 171 is slidably supported within a support block 176, which is connected to the connecting plate 170 at its connection to the mounting plate 169 (see FIG. 9) and is attached to one end of a slide 177 (see FIG. 10) by two bolts (not shown) disposed in two passages 177A, which are enlarged at their upper ends for the heads of the bolts, in the support block 176 and threaded into two threaded holes 177B in the slide 177. The slide 177 is slidably mounted between two L-shaped guide rails 178, which are fixed to the base 175. A wear strip 179 is mounted on the upper surface of the base 175 beneath each of the guide rails 178 and has the bottom surface of the slide 177 sliding thereon.

The piston rod 172 of the air cylinder 171 has a driver 180 connected thereto. The upper end of the driver 180 has a stud 181 extending through an elongated slot 182 (see FIG. 9) in the base slide 136 and into an opening 183 in the slide-cam 153 where the stud 181 (see FIG. 10) is retained. Thus, extension and retraction of the piston rod 172 of the air cylinder 171 causes movement of the slide-cam 153 (see FIG. 9). The elongated slot 182 in the base slide 136 enables the slide-cam 153 to move relative to the base slide 136 when the piston rod 172 (see FIG. 10) is initially extended from the air cylinder 171.

The slide 177 has a stud 184 on its end remote from the support block 176 for disposition within an opening 185 (see FIG. 9) in the base slide 136. Therefore, any motion of the base slide 136 is transmitted to the slide 177 (see FIG. 10).

The base slide 136 (see FIG. 9) has a first folding arm 186 resiliently connected thereto through a screw 187 extending through an opening 188 in the base slide 136 and an opening 189 in the first folding arm 186. A spring 190 is held against the bottom of the first folding arm 186 by a bushing 191 having a threaded opening in its upper end to receive the screw 187. The spring 190 continuously urges the first folding arm 186 upwardly.

The first folding arm 186 has a cam 192 on its upper surface and fixed thereto for cooperation with a cam follower 193 on a finger 194 of the slide-cam 153. The cam follower 193 is exterior of the base slide 136. The first folding arm 186 has a finger 195 attached thereto and extending therefrom. The finger 195 has an angled edge 195', which is formed by an edge of an adjustment plate 196 mounted on the finger 195, for engaging a first outer portion 197 (see FIG. 16) of the strip 20 of material.

The first outer portion 197 of the strip 20 is the portion of the strip 20 extending beyond the clamped fingers 137 and 155. The first outer portion 197 of the strip 20 extends from a middle portion 198, which is held between the clamped fingers 137 and 155 and the clamped fingers 135 and 154. A second outer portion 199 of the strip 20 extends from the opposite side of the middle portion 198 beyond the clamped fingers 135 and 154.

The base slide 136 (see FIG. 9) has a second folding arm 200 resiliently connected thereto in the same manner as the first folding arm 186. The second folding arm 200 has a cam 201 on its upper surface and attached thereto for cooperation with a cam follower 202 (see FIG. 10), which is mounted on the base 175 in spaced relation thereto. The cam follower 202 is located on the base 175 so that the cam 201 (see FIG. 9) will not engage it until after the cam 192 has engaged the cam follower 193 to move the angled edge 195' of the finger 195 relative to the first outer portion 197 (see FIG. 16) of the strip 20 so that the first outer portion 197 is disposed at an angle to the middle portion 198 of the strip 20 and adjacent thereto.

The second folding arm 200 (see FIG. 9) has a finger 203 attached thereto and extending therefrom. The finger 203 has a roughened edge 204 for cooperation with the second outer portion 199 (see FIG. 16) of the strip 20 to insure that the second outer portion 199 does not slip off when the roughened edge 204 (see FIG. 9) is advanced relative to the second outer portion 199 (see FIG. 16) of the strip 20.

A spring 205 (see FIG. 9), which continuously exerts a force on each of the first folding arm 186 and the second folding arm 200, has its end 206 connected to a spring holder 206' on a screw 207, which is one of the screws attaching the cam 192 to the first folding arm 186. The spring 205 has its other end 208 connected to a spring holder 208' on a screw 209, which is one of the screws attaching the cam 201 to the second folding arm 200.

The spring 205 is rotatably supported by the base slide 136 through having a bushing 210 extend through a coiled portion 211 of the spring 205 and held on the base slide 136 by a screw 212. Thus, the spring 205 continuously urges the cam 192 against the cam follower 193 and the cam 201 to a position in which it will engage the cam follower 202 (see FIG. 10).

The air cylinder 171 has pressurized air supplied thereto to extend the piston rod 172 therefrom at the same time that the air cylinder 120 (see FIG. 7) has pressurized air supplied thereto to pivot the guide 116 to its lowermost position. The initial extension of the piston rod 172 (see FIG. 10) causes only sliding motion of the slide-cam 153 (see FIG. 9) so that the cam follower 193 on the slide-cam 153 cooperates with the cam 192 on the first folding arm 186 to move the finger 195 downwardly and inwardly to fold the first outer portion 197 (see FIG. 16) of the strip 20 at an angle to the middle portion 198 and adjacent thereto.

The slide 177 (see FIG. 10) has a pair of longitudinally spaced shallow recesses 215 and 216 of semispherical shape in its bottom surface. When the piston rod 172 (see FIG. 10) is initially extended from the air cylinder 171, the recess 215 has a semi-spherical shaped head of a pin 217 therein. The pin 217 is resiliently biased into the recess 215 by a flat spring 218, which is retained on the bottom of the base 175 by a bracket 219, by the pin 217 extending through an opening 219' in the base 175.

Since the stud 184 connects the slide 177 to the base slide 136 (see FIG. 9), the disposition of the pin 217 (see FIG. 10) in the recess 215 prevents motion of the base slide 136 (see FIG. 9) until the motion of the cam follower 193 on the slide-cam 153 has completed movement of the finger 195 through cooperation with the cam 192 to dispose the first outer portion 197 (see FIG. 16) of the strip 20 beneath the middle portion 198. When the driver stud 181 (see FIG. 10) on the piston rod 172 engages the end of the elongated slot 182 (see FIG. 9) in the base slide 136 to cause movement of the base slide 136 with the slide-cam 153, the slide 177 (see FIG. 10) is moved with the base slide 136 (see FIG. 9) because of the connecting stud 184 (see FIG. 10) whereby the force of the spring 218 is overcome and the pin 217 is moved out of the shallow recess 215. The clamp 140 (see FIG. 9) and the pusher 146 also move with the base slide 136.

Figure 2:
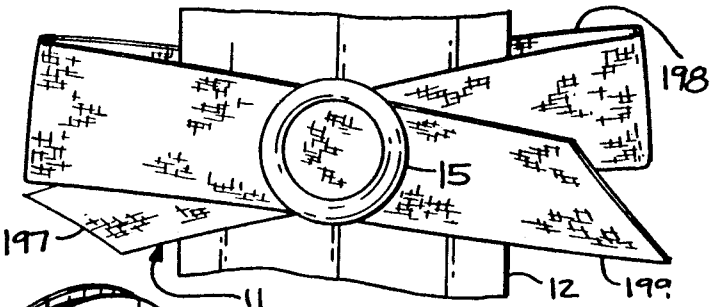
FIG. 2 is a bottom plan view of a bow formed by the bow forming apparatus of FIG. 1 and attached to a garmet by the attaching apparatus of FIG. 1.

The continued extension of the piston rod 172 (see FIG. 10) from the air cylinder 171 causes the cam 201 (see FIG. 9) on the second folding arm 200 to engage the cam follower 202 (see FIG. 10) on the fixed base 175. This moves the roughened edge 204 (see FIG. 9) of the finger 203 inwardly and downwardly relative to the finger 135 to fold the second outer portion 199 (see FIG. 16) of the strip 20 beneath the first outer portion 197 and adjacent thereto. The second outer portion 199 is folded at an angle to both the first outer portion 197 and the middle portion 198 as can be seen in FIG. 2.

Figure 13:
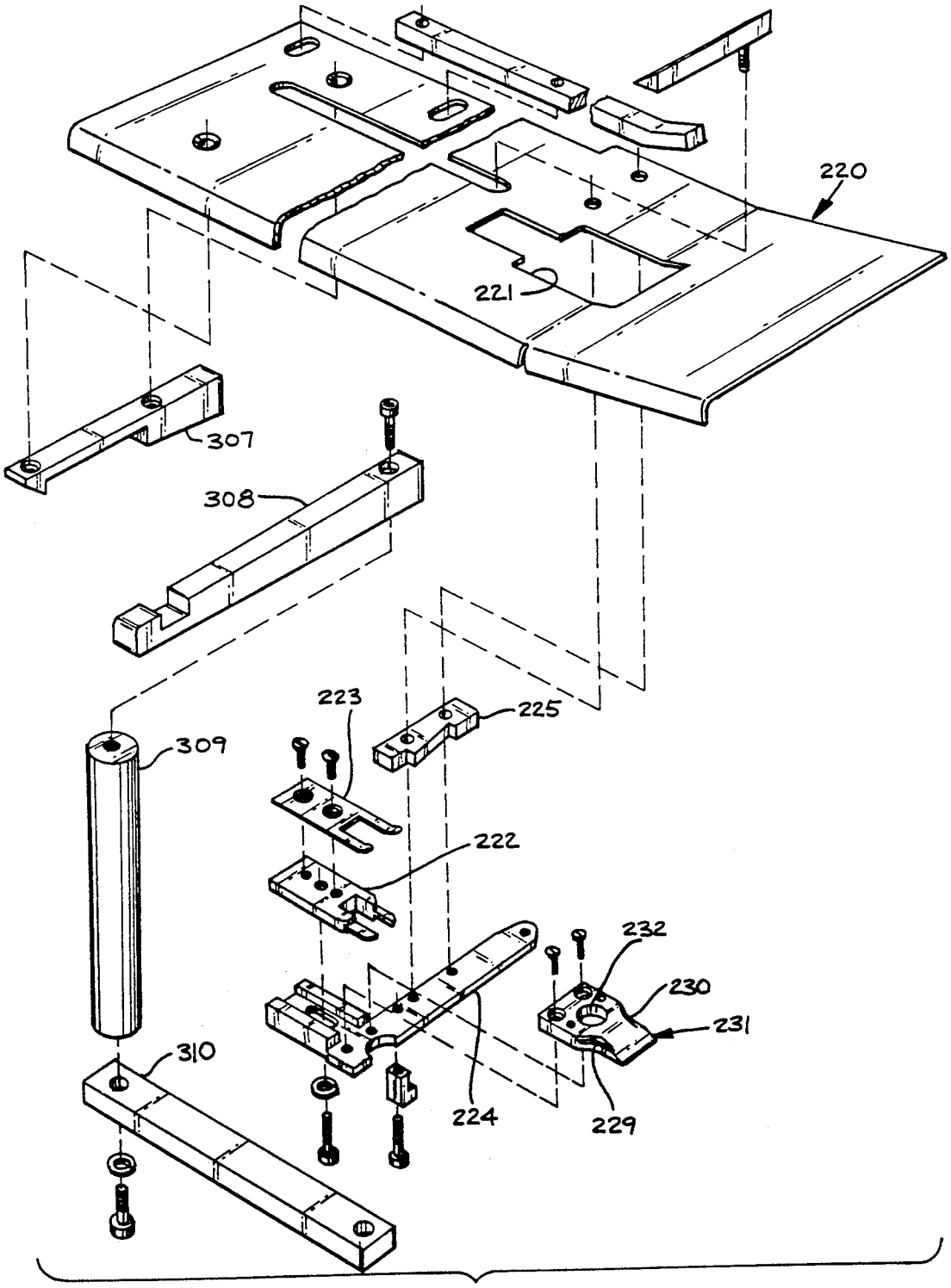
FIG. 13 is an exploded perspective view of a portion of the attaching apparatus for attaching a formed bow to a garment.

The motion of the clamp 140 (see FIG. 9), the pusher 146, the slide-cam 153, the base slide 136, and the slide 177 (see FIG. 10) together moves the folded strip 20 (see FIG. 16) to the attaching apparatus 16 (see FIG. 1). The attaching apparatus 16 includes a table 220 (see FIG. 13) having an opening 221 through which a guide plate 222 projects. A substantially flat guide spring 223 is disposed above the guide plate 222, and both are attached to a mount 224, which is supported in spaced relation to the bottom of the table 220 through a spacer 225.

The advancement of the clamped strip 20 (see FIG. 16) by the continued extension of the piston rod 172 (see FIG. 10) from the air cylinder 171 positions the middle portion 198 (see FIG. 16) of the clamped strip 20 between the guide plate 222 (see FIG. 13) and the guide spring 223. The first outer portion 197 (see FIG. 16) and the second outer portion 199 are disposed beneath the clamped middle portion 198. The extension of the piston rod 172 (see FIG. 10) of the air cylinder 171 is completed at this time.

Figure 10:
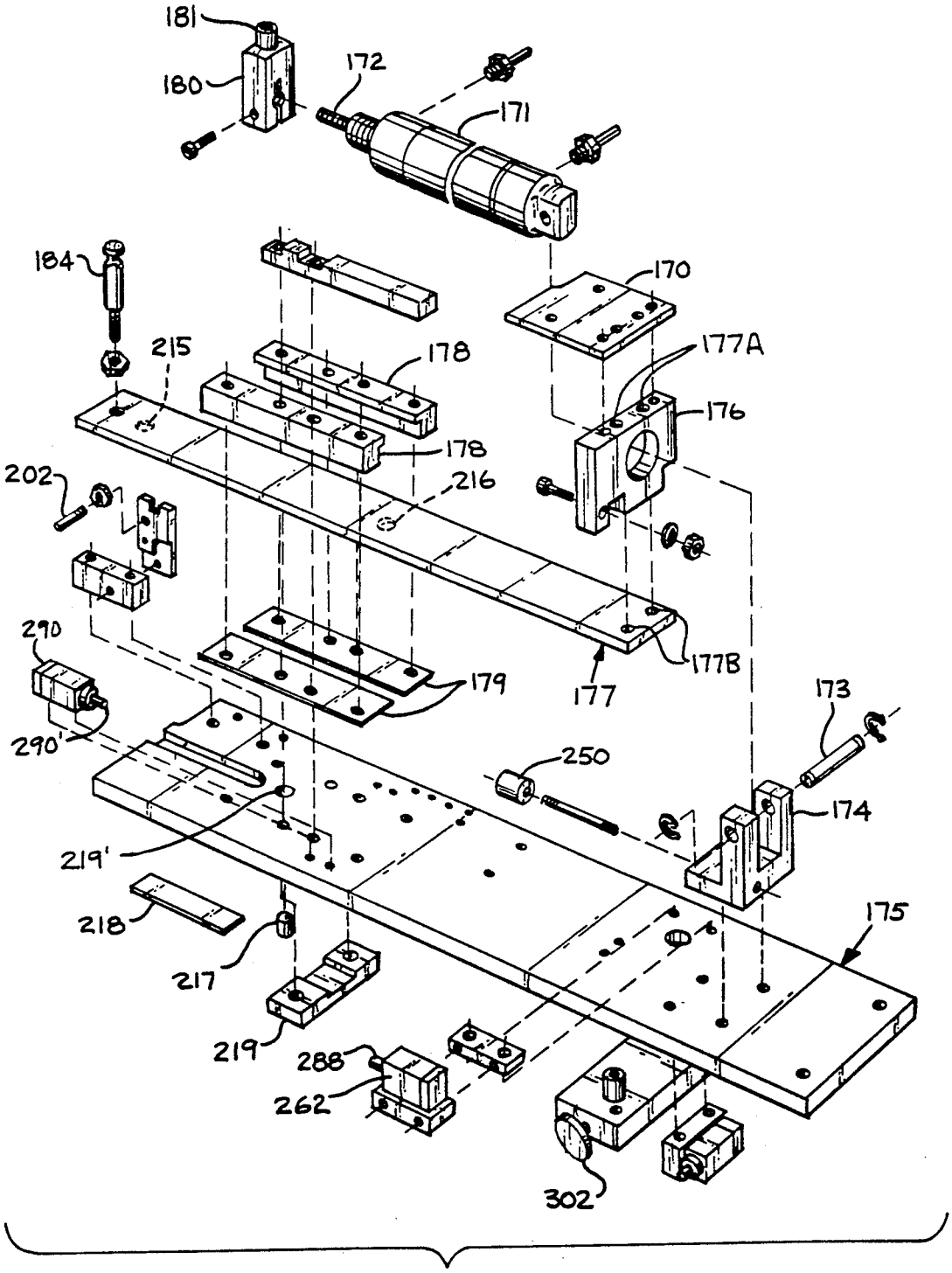
FIG. 10 is an exploded perspective view of the remainder of the folding head slide of the bow forming apparatus of FIG. 1.

Then, pressurized air is supplied to the flat air cylinder 166 (see FIG. 9) to extend the piston rod 167 to move the pusher 146 relative to the clamp 140, the slide-cam 153, the base slide 136, and the slide 177 (see FIG. 10). When the pusher 146 (see FIG. 9) is moved by the piston rod 167, two extending fingers 226 and 227 of a block 228, which is secured to the bottom of the pusher 146, move into grooves 229 (see FIG. 13) and 230 in an anvil 231, which is secured to the mount 224, to engage the first outer portion 197 (see FIG. 16) of the strip 20 and the second outer portion 199 of the strip 20 to insure that they are properly located relative to the middle portion 198 for attachment to each other by the attaching apparatus 16 (see FIG. 1) to create the bow 11 (see FIG. 2) when the attaching apparatus 16 (see FIG. 1) is actuated to connect the first outer portion 197 (see FIG. 16), the middle portion 198, and the second outer portion 199 to the garment 12 (see FIG. 2) through the open ring 15 and the socket 14 (see FIG. 17). The anvil 231 (see FIG. 13) has an opening 232 through which the open ring 15 (see FIG. 2) is guided when the bow 11 is to be attached to the garment 12 by the attaching apparatus 16 (see FIG. 1), which is activated by the operator activating a foot pedal valve 233 (see FIG. 11), for example.

Figure 14:
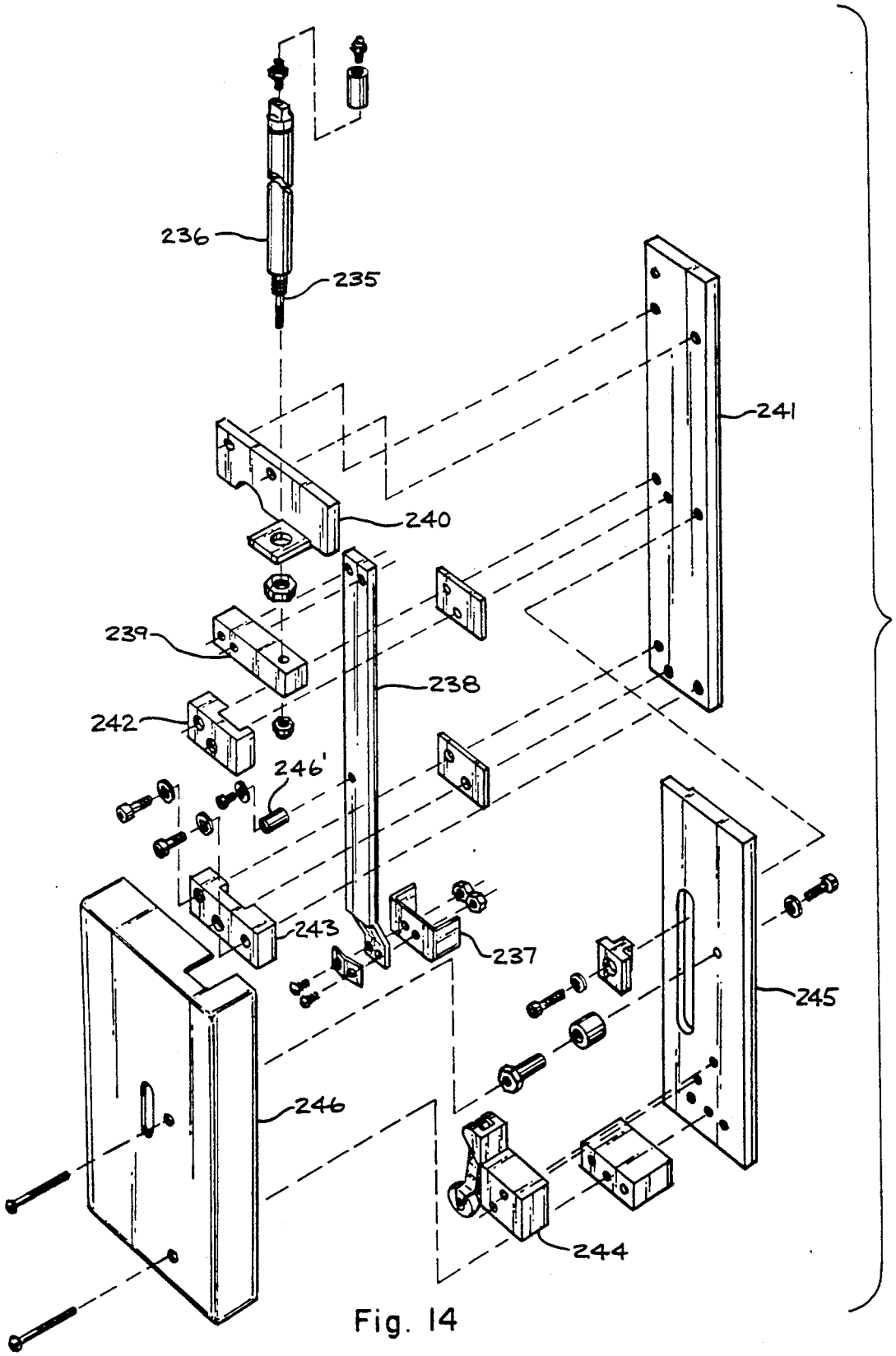
FIG. 14 is an exploded perspective view of a safety trip mechanism used with the attaching apparatus of FIG. 1.

If the operator has an extremity such as a finger, for example, disposed in the area in which the attaching apparatus 16 (see FIG. 1) is going to be attaching the garment 12 (see FIG. 2) to the portions 197 (see FIG. 16), 198, and 199 of the strip 20, downward movement of a piston rod 235 (see FIG. 14) of an air cylinder 236 supported by the attaching apparatus 16 (see FIG. 1) will be prevented after a short amount of travel by a plastic guard 237 (see FIG. 14) engaging the finger of the operator. The guard 237 is mounted at the bottom end of a slide 238 having its upper end connected to a trip bar 239, which is slidably retained on the piston rod 235.

The air cylinder 236 is supported by a mount 240, which is attached to a cover 241 of the attaching apparatus 16 (see FIG. 1). The cover 241 (see FIG. 14) also has an upper guide 242 and a lower guide 243 attached thereto for guiding the slide 238 in a vertical direction.

The cover 241 also has a limit valve 244 supported thereon by an adjustably positioned base valve mount 245. The base valve mount 245 also supports a cover 246.

Thus, the engagement of the guard 237 with a finger of the operator prevents continued movement of the slide 238 with the piston rod 235 of the air cylinder 236. Therefore, there cannot be sufficient movement of the slide 238 to enable a bushing 246' on the slide 238 to shift the position of the limit valve 244 to enable activation of the attaching apparatus 16 (see FIG. 1).

When the piston rod 172 (see FIG. 10) of the air cylinder 171 completes its extension, the shaft 64 (see FIG. 6) of the rotary actuator 65 is rotated in the reverse direction for return to its start position through reversing the flow of pressurized air to the rotary actuator 65. This reverse rotation of the shaft 64 occurs without rotating the drive wheel 62 because the shaft 64 has a one-way roller clutch 247 to prevent rotation of the gear 63 at this time. Similarly, the axle 67 has a one-way clutch 248 to prevent rotation of the gear 66 at this time.

For the bow forming apparatus 10 (see FIG. 1) to be operated, a power switch 249 (see FIG. 12) must be closed. Closing of the power switch 249 connects an AC power source 249A through lines 249B and 249C to a first relay 249D. This energizes a red lamp 249E to indicate that power is being supplied. One suitable example of the first relay 249D is a time relay sold by Guardian Electrical Manufacturing, Chicago, Ill. as Model PET-1481.

When contacts of the relay 249D are closed by depressing a start button 249F to start a cycle of operation in which the ribbon 21' (see FIG. 3) of material is to be cut by the cutting wire 21 (see FIG. 3) or by a signal being received from a cycle sensing switch 249G (see FIG. 12) to indicate that a cycle has been completed in which the bow 11 (see FIG. 2) is attached to the garment 12, the AC power source 249A (see FIG. 12) is connected by conductors 249H and 249I to conductors 249J and 249K, which have a temperature control 249L manually set by a control knob 249' (see FIG. 1) for controlling the voltage produced by the transformer 95' (see FIG. 12) and supplied through the conductors or lines 94 and 95 to the cutting wire 21 (see FIG. 8). This voltage, which can vary from 1.5 volts to 1.75 volts, heats the cutting wire 21.

The conductors 249H (see FIG. 12) and 249I also connect the AC power source 249A to a transformer 249M having an AC output of 20 volts to a rectifier 249N. The rectifier 249N supplies DC power to a second relay 249Q to start a timer (not shown) within the second relay 249Q. One suitable example of the second relay 249Q is a time relay sold by Guardian Electrical Manufacturing, Chicago, Ill. as Model PET-1481.

When the timer of the second relay 249Q completes a predetermined time period (ten seconds, for example) for the cutting wire 21 (see FIG. 8) to be heated sufficiently to cut the ribbon 21' (see FIG. 3) of material, contacts in the second relay 249Q (see FIG. 12) close to supply a DC signal over a conductor 249R to normally closed contacts of the limit microswitch 54 of the sensor 40 (see FIG. 4). If the normally closed contacts of the microswitch 54 (see FIG. 12) are closed, current flows through a conductor 249S, as indicated by a green lamp 249T being illuminated, to energize a solenoid valve 249U.

Energizing the solenoid valve 249U enables the piston rod 90 (see FIG. 8) of the air cylinder 89 to be lifted to raise the heated cutting wire 21 to cut the ribbon 21' (see FIG. 3) of material. If the normally closed contacts of the microswitch 54 (see FIG. 12) are opened and normally open contacts of the microswitch 54 are closed because the ribbon 21' (see FIG. 3) of material is too thick, then a red lamp 249 V (see FIG. 12) is energized, and the solenoid 249U cannot be energized so that a cycle of operation is stopped until the thickened portion of the ribbon 21' (see FIG. 3) of material is manually cut and removed.

When the second relay 249Q (see FIG. 12) receives a signal from the rectifier 249N, a red lamp 249W is illuminated to indicate that the timer in the second relay 249Q is activated. However, cutting cannot occur until the timer in the second relay 249Q completes its predetermined time period to allow the second relay 249Q to supply DC current to the solenoid valve 249U. The lamp 249W goes off when the timer in the second relay 249Q has counted the predetermined period of time.

When the DC output signal from the second relay 249Q flows through the normally closed contacts of the microswitch 54 to the solenoid valve 249U, the lamp 249T is energized. This indicates that the cutting wire 21 (see FIG. 8) is at its operating temperature.

A cycle of operation will be described beginning with the piston rod 172 (see FIG. 10) of the air cylinder 171 in its fully retracted position so that a bumper 250, which is supported on the L-shaped mount 174 on the base 175, is engaged by the support block 176 on the slide 177. The piston rod 172 is in its fully retracted position due to pressurized air being supplied from a pressurized air supply source (not show) through a line 251 (see FIG. 11), a valve 252, a line 253, a line 254, a valve 255, and a line 256 to the air cylinder 171. The line 256 is connected through a line 257, a one-way restrictor 258, and an accumulator 259 to shift a valve 260 from the position of FIG. 11. This shifting supplies pressurized air from the pressurized air supply source through a line 261 and the valve 260 to the tube 115L as soon as retraction of the piston rod 172 begins. One suitable example of the one-way restrictor 258 is a control valve sold by Humphrey, Kalamazoo, Mich. as Model TACSC1.

When the piston rod 172 is fully retracted, a valve 262, which is mounted on the base 175 (see FIG. 10), has its position shifted by the support block 176 on the slide 177 from that shown in FIG. 11 whereby pressurized air is supplied from the pressurized air source through the line 251, the valve 252, the line 253, a line 263, the valve 262, and a line 264 to the rotary actuator 65 and pressurized air is exhausted from the rotary actuator 65 through a line 265. The pressurized air in the line 264 causes the rotary actuator 65 to rotate the drive wheel 62 (see FIG. 6) to advance the ribbon 21' (see FIG. 3) of material from the spool 22 past the cutting wire 21 (see FIG. 8).

Pressurized air in the line 264 (see FIG. 11) also flows through a line 266 to a single shot 267, which produces a single air pulse each time that pressurized air is supplied to the line 266. One suitable example of the single shot 267 is a one shot valve sold by Clippard Instrument Laboratory, Cincinnati, Ohio as Model P3-1T.

The single air pulse output from the single shot 267 is supplied through a line 268 to a valve 269 to shift the valve 269 to the position shown in FIG. 11. This shifted position of the valve 269 allows pressurized air to flow from the line 253 through a line 270 and the valve 269 to a line 271.

The line 271 supplies pressurized air to the air cylinder 120 to retract the piston rod 119 to lift the guide 116 (see FIG. 7) upwardly so that the ribbon 21' (see FIG. 3) of material can be advanced to the guide 116 (see FIG. 7). Pressurized air also is supplied from the line 271 (see FIG. 11) to a line 272 to the air jet tubes 129 and 130, which are mounted on the sides 125A (see FIG. 7) and 125B of the guide 116.

Therefore, the guide 116 is positioned to receive the ribbon 21' (see FIG. 3) of material when the ribbon 21' of material is advanced by the pressure wheel 62 (see FIG. 6) being rotated by the rotary actuator 65. The air jet tubes 129 (see FIG. 7) and 130 also simultaneously apply pressurized air to guide the ribbon 21' (see FIG. 3) of material along the guide 116 (see FIG. 7).

When the rotary actuator 65 (see FIG. 6) completes its rotation of the drive wheel 62 by engaging an adjustable mechanical stop (not shown), the ribbon 21' (see FIG. 3) of material has been advanced a selected amount equal to the length of the strip 20 (see FIG. 16) of material. The completion of rotation of the rotary actuator 65 (see FIG. 6) shifts the position of the limit valve 112 whereby pressurized air is supplied from the source through a line 273 (see FIG. 11), the valve 112, a line 274, and a line 275 to a line 276 to supply pressurized air to the air cylinder 106 to have the piston 105 (see FIG. 5) move the hold-down wire 101 downwardly for disposition against the ribbon 21' (see FIG. 3) of material on the opposite side of the ribbon 21' of material from the cutting wire 21 (see FIG. 8) to hold the ribbon 21' (see FIG. 3) of material when the cutting wire 21 (see FIG. 8) cuts the ribbon 21' (see FIG. 3) of material.

Pressurized air also flows through the valve 112 (see FIG. 11) from the line 273 to the lines 274 and 275 to shift the position of the valve 269 from the position shown in FIG. 11 and to shift a valve 277 to the position shown in FIG. 11. The shifted position of the valve 269 allows pressurized air to flow from the source through the line 251, the valve 252, the lines 253 and 270, the valve 269, and a line 278 to the air cylinder 120 while venting the pressurized air from the other end of the air cylinder 120 through the line 271. This causes extension of the piston rod 119 (see FIG. 7) to pivot the guide 116 downwardly. The venting of the line 271 (see FIG. 11) simultaneously removes air pressure from the air jet tubes 129 and 130.

At the same time, the shifting of the position of the valve 277 to that shown in FIG. 11 allows pressurized air to be exhausted from the air cylinder 158 through a line 279. This results in the spring 147 (see FIG. 9) forcing the clamp 140 downwardly so that the fingers 154 and 155 cooperate with the fingers 135 and 137, respectively, to clamp therebetween the portion of the ribbon 21' (see FIG. 3) of material that has been advanced by the drive wheel 62 (see FIG. 6).

The line 275 (see FIG. 11) also supplies pressurized air through the solenoid valve 249U, if it is energized, and a line 280 to the air cylinder 89 to raise the cutting wire 21 (see FIG. 8). The solenoid valve 249U (see FIG. 11) is energized if the cutting wire 21 (see FIG. 8) has been heated for a predetermined period of time (ten seconds, for example) sufficient for the cutting wire 21 to cut the ribbon 21' (see FIG. 3) of material and the ribbon 21' of material does not exceed a predetermined thickness.

If the normally closed contacts of the limit microswitch 54 (see FIG. 4) have been opened by movement of the bar 46 of the thickness sensor 40 because the ribbon 21' (see FIG. 3) of material exceeds the predetermined thickness or the cutting wire 21 (see FIG. 8) has not been heated for the predetermined period of time to cut the ribbon 21' (see FIG. 3) of material so that contacts of the second relay 249Q (see FIG. 12), which has the timer to time how long the cutting wire 21 (see FIG. 8) has been heated, are open, then the solenoid valve 249U (see FIG. 11) is not energized and blocks communication between the lines 275 and 280. If the cutting wire 21 (see FIG. 8) has not been heated for the predetermined period of time, it will become heated sufficiently when the predetermined period of time expires to cause the timer in the second relay 249Q (see FIG. 12) to close the contacts of the second relay 249Q to energize the solenoid valve 249U (see FIG. 11) if the thickness of the ribbon 21' (see FIG. 3) of material does not exceed the predetermined thickness.

However, if the normally closed contacts of the limit microswitch 54 (see FIG. 4) have been opened, it is necessary to turn off the bow forming apparatus 10 (see FIG. 1) by opening the power switch 249 (see FIG. 12) and remove the ribbon 21' (see FIG. 3) of material from the ribbon guide assembly 55 (see FIG. 5) to manually cut the portion of the ribbon 21' (see FIG. 3) of material that exceeds the predetermined thickness. This necessitates starting another cycle by depressing the power switch 249 (see FIG. 12) and the start button 249F.

When the piston rod 90 (see FIG. 8) of the air cylinder 89 is retracted to raise the heated cutting wire 21 to cut the ribbon 21' (see FIG. 3) of material, the limit valve 96 (see FIG. 8) has its position switched by the trip rod 98 because the heated cutting wire 21 has been raised to its maximum position. This shifting of the position of the limit valve 96 to the position of FIG. 11 enables the supply of pressurized air from the source through a line 281 and the limit valve 96 to a line 282, which supplies pressurized air to shift the position of the valve 255 from the position shown in FIG. 11. In this shifted position, the valve 255 allows pressurized air to flow through the line 253, the line 254, and the valve 255 to a line 283. The line 283 supplies pressurized air to the air cylinder 171 to start extension of the piston rod 172 therefrom.

Shifting of the valve 255 from the position of FIG. 11 also vents pressurized air from the line 256, which is connected to the opposite end of the air cylinder 171 from the line 283. The line 256 has the cycle sensing switch 249G connected thereto by a line 284 to send an electrical signal to the first relay 249D (see FIG. 12) to indicate that another cycle is occurring when pressurized air is initially supplied to the line 256 (see FIG. 11) to retract the piston rod 171 of the air cylinder 172. This keeps the contacts of the first relay 249D (see FIG. 12) closed to maintain the cutting wire 21 (see FIG. 8) heated unless a timer within the first relay 249D (see FIG. 12) has already exceeded a predetermined time period and opened its contacts.

Because of the presence of the one-way restrictor 258 (see FIG. 11) in the line 257 to reduce air flow from the accumulator 259 when the line 256 is vented, shifting of the valve 260 by its spring 286 does not occur immediately upon removal of pressurized air from the line 257. Thus, pressurized air is supplied through the valve 260 and the tube 115L to the tube 115B (see FIG. 15) of the filter assembly 115A until the time that the cutting wire 21 (see FIG. 8) is returned to its start position. The size of the one-way restrictor 258 (see FIG. 11) is selected to insure that its time for release of the pressure on the valve 260 to enable shifting of the valve 260 to stop pressurized air flow to the tube 115L does not occur until the cutting wire 21 (see FIG. 8) has returned to its start position.

When the position of the valve 255 (see FIG. 11) is shifted to supply pressurized air through the line 283 to the air cylinder 171 to begin extension of the piston rod 172, a spring 287 shifts the valve 262 from its position of FIG. 11 since the support block 176 (see FIG. 10) on the slide 177 is no longer engaging a plunger 288 on the valve 262 to overcome the force of the spring 287 (see FIG. 11). This results in the rotary actuator 65 rotating in the reverse direction. Because of the one-way clutches 247 (see FIG. 6) and 248, the drive wheel 62 is not driven at this time since the rotary actuator 65 is rotating the shaft 64 in the opposite direction to that in which the ribbon 21' (see FIG. 3) of the material is advanced.

When the rotary actuator 65 (see FIG. 11) begins to rotate in the opposite direction, it no longer holds the roller 110 of the limit valve 112 so that the limit valve 112 shifts to the position in which it blocks the flow of pressurized air therethrough. Thus, pressurized air is removed from the air cylinder 106 and the line 275.

When pressurized air is removed from the air cylinder 106, the spring 107 lifts the clamp plate 102 (see FIG. 5) to move the hold-down wire 101 upwardly. This shifting of the limit valve 112 (see FIG. 11) also vents pressurized air from the air cylinder 89 so that the spring 100' can return the cutting wire 21 (see FIG. 8) to its start position beneath the path of the ribbon 21' (see FIG. 3) of material.

When the cutting wire 21 (see FIG. 8) is returned to its lowermost or start position, the limit valve 96 again has its position shifted from that shown in FIG. 11. As a result, pressurized air is removed from the line 282.

When the piston rod 172 of the air cylinder 171 is at its maximum extension so that the strip 20 (see FIG. 16) of material is at the attaching apparatus 16 (see FIG. 16) a valve 290 (see FIG. 10), which is mounted on the base 175, has its plunger 290' engaged by the support block 176 on the slide 177 to shift the valve 290 from its position of FIG. 11. Shifting of the valve 290 from its position of FIG. 11 allows the attaching apparatus 16 to be activated by the operator depressing a foot pedal 291 of the foot pedal valve 233 if the limit valve 244 (see FIG. 14) has not been closed by the guard 237 engaging the operator's finger. Depressing the foot pedal 291 (see FIG. 11) permits pressurized air to flow from the source through a line 292, the foot pedal valve 233, a line 293, the valve 290, and lines 293' and 294 to the attaching apparatus 16 to activate the attaching apparatus 16.

A line 295 extends from the line 293' to the pusher air cylinder 166 to extend the piston rod 167 to advance the fingers 226 (see FIG. 9) and 227 on the pusher 146 into the grooves 229 (see FIG. 13) and 230 on the anvil 231 to engage the outer portions 197 (see FIG. 16) and 199 of the strip 20. This insures that the outer portions 197 and 199 of the strip 20 are properly positioned relative to the middle portion 198.

When pressurized air is removed from the pusher air cylinder 166 (see FIG. 11) by the foot pedal 291 being released by the operator, the fingers 226 (see FIG. 9) and 227 on the pusher 146 are withdrawn from the grooves 229 (see FIG. 13) and 230 on the anvil 231 by a return spring 296 (see FIG. 9), which has one end attached to the pusher 146 and its other end secured to the adjustment bar 168. The return spring 296 moves the pusher 146 relative to the clamp 140, the slide-cam 153, and the base slide 136 to its retracted position.

After the attaching apparatus 16 (see FIG. 1) is operated to attach the bow 11 (see FIG. 2) to the garment 12, pressurized air from the attaching apparatus 16 (see FIG. 11) is supplied through a line 297 to a single shot 298, which is the same as the single shot 267. The single shot 298 produces a single air pulse on lines 299 and 300 to shift the position of the valve 255 to its position of FIG. 11 and through the line 299 and a line 301 to shift the position of the valve 277 from its position of FIG. 11.

Shifting of the valve 277 allows pressurized air to flow through the valve 277 and the line 279 to the air cylinder 158 whereby the clamp 140 (see FIG. 9) is raised upwardly by the piston 159 of the air cylinder 158. The raising of the clamp 140 removes the fingers 154 and 155 from holding the strip 20 (see FIG. 16), which has now been formed into the bow 11 (see FIG. 2).

Shifting of the valve 255 (see FIG. 11) allows pressurized air to be supplied through the line 256 to air cylinder 171 to begin retraction of the piston rod 172. This also supplies pressurized air from the line 256 through the line 257, the one-way restrictor 258, and the accumulator 259 to the valve 260 to shift its position so that pressurized air flows to the tube 115L.

When the piston rod 172 of the air cylinder 171 is fully retracted, the valve 262 is again shifted to start another rotation of the rotary actuator 65 to advance the ribbon 21' (see FIG. 3) of material.

If an emergency should develop, an emergency stop valve 302 (see FIG. 11) can be actuated. The actuation of the valve 302 supplies pressurized air from the source through a line 303 and the valve 302 to a line 304 to shift the valve 252 from its position of FIG. 11. This shifting of the position of the valve 252 vents the line 253 and all the lines connected thereto.

When the emergency stop valve 302 is actuated, pressurized air is simultaneously supplied from the line 303 through the valve 302 and a line 305 to the valve 290. This simultaneously shifts the valve 290 to its position of FIG. 11 to remove any supply of pressurized air to the attaching apparatus 16 through the lines 293' and 294. When the emergency stop valve 302 is released, the lines 304 and 305 are vented through the emergency stop valve 302.

It should be understood that each of the valves 252, 255, 269, and 277 is detented in the position to which it is moved by air pressure applied to one end of the valve until air pressure is applied to its other end to shift the valve. The valve is detented in its shifted position until air pressure is again applied to its one end. Thus, air pressure does not have to be maintained to hold the valve in the position to which it is shifted and only a single pressurized air pulse is needed to shift the valve.

While the present invention has shown and described the bow forming apparatus 10 (see FIG. 1) as being utilized with the attaching apparatus 16, it should be understood that any other suitable means including a sewing machine may be employed for attaching the portions 197 (see FIG. 16), 198, and 199 of the strip 20 to the garment 12 (see FIG. 2) to form the bow 11. Additionally, the portions 197 (see FIG. 16), 198, and 199 of the strip 20 also may be attached to each other by any suitable attaching means including a sewing machine without being attached to the garment 12 (see FIG. 2) if desired.

It should be understood that a cover 306 (see FIG. 1) is removably supported by the base 175 (see FIG. 10).

It should be understood that the table 220 (see FIG. 13) is supported by a base plate (not shown) of the attaching apparatus 16 (see FIG. 1). The table 220 has an interlock 307 (see FIG. 13) engaging a rest 308, which is secured to a post 309 attached to a connector bar 310 supported by the base plate of the attaching apparatus 16 (see FIG. 1).

As used in the claims, the angle at which the first outer portion 197 is folded relative to the middle portion 198 is the angle produced when viewed from the top or bottom as shown in FIG. 2. Likewise, as used in the claims, the angle at which the second outer portion 199 is folded relative to each of the first outer portion 197 and the middle portion 198 is the angle produced when viewed from the top or bottom as shown in FIG. 2.

An advantage of this invention is that a bow may be automatically formed and attached to a garment. Another advantage of this invention is that an operator is protected against being harmed if the operator has an extremity positioned so as to be struck by a portion of the attaching apparatus when the attaching apparatus is activated.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

I claim:

1. An apparatus for forming a bow from a strip of material having a middle portion joining first and second outer portions to each other including:

holding means for holding the middle portion of the strip of material;

first folding means for folding the first outer portion of the strip of material at an angle to the middle portion of the strip of material and adjacent the middle portion of the strip of material while said holding means holds the middle portion of the strip of material, said first folding means holding the first outer portion of the strip of material at the angle to the middle portion of the strip of material and adjacent thereto after the first outer portion of the strip of material is folded by said first folding means;

second folding means for folding the second outer portion of the strip of material at an angle to each of the first outer portion and the middle portion of the strip of material after said first folding means is holding the first outer portion of the strip of material at the angle to the middle portion of the strip of material and adjacent thereto, said second folding means folding the second outer portion of the strip of material adjacent the first outer portion of the strip of material, said second folding means holding the second outer portion of the strip of material at the angle to each of the first outer portion and the middle portion of the strip of material and adjacent the first outer portion of the strip of material after the second outer portion of the strip of material is folded by said second folding means;

and attaching means for attaching the folded first outer portion, the middle portion, and the folded second outer portion of the strip of material to each other to form a bow while said holding means holds the middle portion of the strip, said first folding means holds the first outer portion of the strip, and said second folding means holds the second outer portion of the strip.

2. The apparatus according to claim 1 in which:

said first folding means includes:

engaging means for engaging the first outer portion of the strip of material;

moving means for moving said engaging means relative to said holding means to cause folding of the first outer portion of the strip of material at the angle to the middle portion of the strip of material and adjacent the middle portion of the strip of material;

and said engaging means holding the first outer portion of the strip of material at the angle to the middle portion of the strip of material and adjacent thereto after the first outer portion of the strip of material is folded;

said second folding means includes:

engaging means for engaging the second outer portion of the strip of material;

moving means for moving said engaging means of said second folding means relative to said holding means to cause folding of the second outer portion at the angle to each of the first outer portion and the middle portion of the strip of material and adjacent the folded first outer portion of the strip of material;

and said engaging means of said second folding means holding the second outer portion of the strip of material at the angle to each of the first outer portion and the middle portion of the strip of material and adjacent the first outer portion of the strip of material after the second outer portion of the strip of material is folded;

and control means for controlling said moving means of each of said first folding means and said second folding means so that said engaging means of said first folding means has completed folding of the first outer portion of said strip of material prior to said moving means of said second folding means moving said engaging means of said second folding means.

3. The apparatus according to claim 2 including advancing means for advancing said holding means and each of said first folding means and said second folding means from a first position at which said engaging means of said first folding means has completed folding of the first outer portion of the strip of material and said engaging means of said second folding means has completed folding of the second outer portion of the strip of material to a second position at which said attaching means is effective.

4. The apparatus according to claim 3 including:

a supply source of the material;

material advancing means for advancing a selected length of the material equal to the length of a strip of material to a position at which said holding means is disposed to receive the selected length of the material when said material advancing means advances the selected length of the material so that said holding means holds the middle portion of the strip of material after the selected length of material is advanced by said material advancing means;

and cutting means for cutting the advanced selected length of the material to form a strip of material, said cutting means being effective after said holding means is effective.

5. The apparatus according to claim 4 in which:

the material is a heat cutting material;

and said cutting means includes heated cutting means for cutting the heat cutting material.

6. The apparatus according to claim 5 in which said material advancing means includes:

advancing means engaging the material to advance the selected length of the material during each activation of said advancing means;

guide means for guiding the material from said heated cutting means to said holding means when said advancing means engages the material to advance the material;

and moving means for moving said guide means between a first position in which said guide means guides the material to said holding means and a second position in which said guide means is spaced from the material held by said holding means.

7. The apparatus according to claim 6 including:

activating means for activating said moving means of said material advancing means for moving said guide means from its first position to its second position no later than when said advancing means of said material advancing means starts to advance the selected length of the material;

and said activating means activating said moving means of said material advancing means for moving said guide means from its second position to its first position before said heated cutting means cuts the material and after said holding means is effective.

8. The apparatus according to claim 7 in which said holding means includes:

support means for supporting the material when said advancing means of said material advancing means advances the material along said guide means to said holding means;

and clamping means for clamping the advanced material against said support means of said holding means upon completion of advancement of the selected length of the material by said advancing means of said material advancing means.

9. The apparatus according to claim 8 including means for moving said heated cutting means into engagement with the material to cut the material only after said clamping means is effective and said heated cutting means has been heated for a period of time sufficient to cut the material.

10. The apparatus according to claim 6 including said guide means having means for applying pressurized air to opposite sides of the material during its advancement along said guide means by said advancing means of said material advancing means.

11. The apparatus according to claim 5 including:

sensing means for sensing the thickness of the material being advanced by said material advancing means;

and means responsive to said sensing means for preventing use of the material when the thickness of the material exceeds a predetermined thickness as a strip of material for forming a bow.

12. The apparatus according to claim 5 including enabling means for enabling movement of said heated cutting means to cut the material only when said heated cutting means has been heated for a predetermined period of time sufficient to cut the material.

13. The apparatus according to claim 5 including activation preventing means for preventing activation of said attaching means when an operator has an extremity in an area in which said attaching means can engage the extremity.

14. The apparatus according to claim 5 including:

gas removing means disposed adjacent said heated cutting means for removing gases produced during cutting of the material by said heated cutting means;

and said gas removing means including:

filter means for filtering the gases produced during cutting of the material by said heated cutting means;

communicating means communicating the area in which said heated cutting means cuts the material with said filter means;

causing means for causing the gases to flow into said communicating means and through said communicating means to said filter means;

and said causing means being effective prior to said heated cutting means being effective and remaining effective at least until said heated cutting means ceases to be effective.

15. The apparatus according to claim 3 including insuring means for insuring that each of the folded first and second outer portions of the strip of material is at its desired position prior to said attaching means being effective when said holding means and each of said first folding means and said second folding means have been advanced to the second position at which said attaching means is effective.

16. The apparatus according to claim 1 including causing means for causing another cycle of operation after said attaching means is effective, said causing means being responsive to a signal from said attaching means.

17. The apparatus according to claim 1 including advancing means for advancing said holding means and each of said first folding means and said second folding means from a position at which said first folding means has completed folding of the first outer portion of the strip of material and said second folding means has completed folding of the second outer portion of the strip of material to a position at which said attaching means is effective.

18. The apparatus according to claim 1 including:

pneumatic means supported by said attaching means;

vertically movable engaging means for engaging an operator's extremity when the extremity is disposed in an area in which the extremity will be struck by said attaching means when said attaching means is effective;

said pneumatic means causing movement of said vertically movable engaging means, prior to said attaching means being effective, into the area in which the operator's extremity will be struck by said attaching means when said attaching means is effective;

and preventing means for preventing said attaching means from being effective if said vertically movable engaging means engages the operator's extremity in the area when said pneumatic means causes movement of said vertically movable engaging means.

19. The apparatus according to claim 1 including:

movable means supported by said attaching means;

vertically movable engaging means for engaging an operator's extremity when the extremity is disposed in an area in which the extremity will be struck by said attaching means when said attaching means is effective;

said movable means causing movement of said vertically movable engaging means, prior to said attaching means being effective, into the area in which the operator's extremity will be struck by said attaching means when said attaching means is effective;

and preventing means for preventing said attaching means from being effective if said vertically movable engaging means engages the operator's extremity in the area when said movable means causes movement of said vertically movable engaging means.

* * * * *

UNITED STATES PATENT AND TRADEMARK OFFICE

CERTIFICATE OF CORRECTION

PATENT NO. : 5,297,705

DATED : March 29, 1994

INVENTOR(S) : Erich A. Schmidt

It is certified that error appears in the above-identified patent and that said Letters Patent is hereby corrected as shown below:

Column 1, line 63, "garmet" should read --- garment ---.

Column 2, line 60, "a" should read --- the ---.

Column 2, line 64, "meat" should read --- heat ---.

Column 5, line 51, after "angle" insert --- of ---.

Column 7, line 37, "125" should read --- 135 ---.

Column 12, line 65, "(see FIG. 3) should read --- (see FIG. 8) ---.

Column 13, line 63, "show" should read --- shown ---.

Column 17, line 3, "(see FIG. 16)" should read --- (see FIG. 1) ---.

Signed and Sealed this

Twenty-seventh Day of September, 1994

*Attest:*

Bruce Lehman

BRUCE LEHMAN

*Attesting Officer*

*Commissioner of Patents and Trademarks*